US011007563B2

(12) United States Patent
Suto et al.

(10) Patent No.: US 11,007,563 B2
(45) Date of Patent: May 18, 2021

(54) WIRE BENDING MACHINE

(71) Applicant: ADVANCED ORTHODONTIC SOLUTIONS, INC., Tampa, FL (US)

(72) Inventors: Tony Suto, Elburn, IL (US); Constantine Grapsas, Tampa, FL (US); Piotr Cison, Burr Ridge, IL (US)

(73) Assignee: Advanced Orthodontic Solutions, Tampa, FL (US)

( * ) Notice: Subject to any disclaimer, the term of this patent is extended or adjusted under 35 U.S.C. 154(b) by 749 days.

(21) Appl. No.: 15/498,675

(22) Filed: Apr. 27, 2017

(65) Prior Publication Data

US 2017/0312808 A1 Nov. 2, 2017

Related U.S. Application Data

(60) Provisional application No. 62/328,444, filed on Apr. 27, 2016.

(51) Int. Cl.

| | |
|---|---|
| ***B21F 1/00*** | (2006.01) |
| ***B21F 11/00*** | (2006.01) |
| ***B21F 23/00*** | (2006.01) |

(52) U.S. Cl.

CPC ..... *B21F 1/00* (2013.01); *B21F 1/008* (2013.01); *B21F 11/00* (2013.01); *B21F 23/00* (2013.01)

(58) Field of Classification Search

CPC .. B21F 1/00; B21F 1/006; B21F 1/008; B21F 23/00; B21F 23/002; B21F 11/00; B21D 7/021; B21D 7/04; B21D 7/02; B21D 7/028; B21D 7/06; B21D 7/024

See application file for complete search history.

(56) References Cited

U.S. PATENT DOCUMENTS

| | | | |
|---|---|---|---|
| 4,207,567 | A | 6/1980 | Juengel |
| 5,464,349 | A | 11/1995 | Andreiko |
| 5,553,895 | A | 9/1996 | Karl |
| 5,683,243 | A | 11/1997 | Andreiko |
| 6,015,289 | A | 1/2000 | Andreiko |
| 6,244,861 | B1 | 6/2001 | Andreiko |
| 6,616,414 | B2 | 9/2003 | Yoo |

(Continued)

FOREIGN PATENT DOCUMENTS

| | | |
|---|---|---|
| DE | 19736468 | 2/1998 |
| EP | 0949021 | 10/1999 |

(Continued)

OTHER PUBLICATIONS

European Search Report for Application No. 17168515.9 dated Sep. 20, 2017 (pp. 9).

*Primary Examiner* — Pradeep C Battula

(74) *Attorney, Agent, or Firm* — Fitch, Even, Tabin and Flannery LLP

(57) ABSTRACT

A simplified wire bending machine is provided comprising a bending head with an integrated wire cutoff mechanism. The bending head comprises an inner portion, wherein the inner portion includes a wire bending channel; and an outer portion, wherein the outer portion includes a cutting edge and one or more bending pins. The outer portion is rotatable about the inner portion such that a bending pin is capable of bending a wire around the inner portion. Further, the outer portion is movable from a first position to a second position in which the cutting edge is configured to engage and shear a wire.

15 Claims, 17 Drawing Sheets

(56) References Cited

U.S. PATENT DOCUMENTS

| | | | | |
|---|---|---|---|---|
| 6,616,444 | B2 | 9/2003 | Andreiko | |
| 6,817,220 | B2 * | 11/2004 | Liu | B21F 1/00 72/137 |
| 6,846,179 | B2 | 1/2005 | Chapouland | |
| 7,094,053 | B2 | 8/2006 | Andreiko | |
| 7,134,310 | B2 * | 11/2006 | Hu | B21D 7/021 72/307 |
| 7,229,282 | B2 | 6/2007 | Andreiko | |
| 7,293,444 | B2 * | 11/2007 | Hacker | B21D 7/024 72/157 |
| 8,359,896 | B2 * | 1/2013 | Wolf | B21D 7/02 72/307 |
| 8,616,036 | B2 * | 12/2013 | Jaubert | B21D 7/024 72/149 |
| 8,631,674 | B2 * | 1/2014 | Christofilis | B21F 1/00 72/306 |
| 9,067,255 | B2 * | 6/2015 | Fries | B21F 1/00 |
| 9,566,636 | B2 * | 2/2017 | Del Fabro | B21F 1/00 |
| 9,592,546 | B2 * | 3/2017 | Christofilis | B21F 1/06 |
| 9,604,271 | B2 * | 3/2017 | Pace | B21D 7/04 |
| 9,751,122 | B2 * | 9/2017 | Carruthers | B21D 7/024 |
| 10,232,424 | B2 * | 3/2019 | Koechig | B21D 7/06 |
| 10,639,693 | B2 * | 5/2020 | Yogo | B21D 7/024 |
| 2005/0103080 | A1 * | 5/2005 | Anagnostopoulos | B21F 1/00 72/306 |
| 2009/0173127 | A1 * | 7/2009 | Pace | B21D 7/024 72/149 |
| 2010/0275668 | A1 | 11/2010 | Riemeier | |
| 2017/0312808 | A1 * | 11/2017 | Suto | B21F 1/008 |
| 2017/0355005 | A1 * | 12/2017 | Grapsas | B21F 1/006 |
| 2018/0250778 | A1 * | 9/2018 | Fumagalli | B21D 7/02 |
| 2020/0130038 | A1 * | 4/2020 | Mock | B21F 1/006 |

FOREIGN PATENT DOCUMENTS

| | | |
|---|---|---|
| EP | 1388383 | 2/2004 |
| GB | 2172229 | 9/1986 |

* cited by examiner

WIRE BENDING MACHINE

RELATED APPLICATIONS

This application claims the benefit of U.S. Provisional Application No. 62/328,444 filed Apr. 27, 2016, which is hereby incorporated by reference in its entirety.

FIELD OF THE INVENTION

This invention relates generally to wire bending and automated wire bending machines. More particularly this invention relates to a simplified wire bending machine.

BACKGROUND OF THE INVENTION

Automated wire bending machines are used to create accurate and complex bends in a variety of materials, cross-sectional shapes, and sizes. Automated wire bending machines may be operated, for example, through computer numerical control (CNC). CNC wire bending machines allow a user to design a shape using a computer or other processing device, and have the machine create the shape consistently according to a part program. By automating the wire-forming process, complicated parts can be made beyond the capabilities of ordinarily skilled human craftsmen. Further, CNC wire bending machines may be used to create precise parts repeatedly, reducing the need to inspect or rework individual parts. For instance, the creation of wire grocery carts requires many precise bends which are not easy to manually execute.

Automated wire bending machines are used with various kinds of wire. Wire may be fed directly from coil stock to the wire bending machine, or may be supplied in straight segments.

A variety of automated wire benders are known in the art. These include two-dimensional machines, in which the finished wire is substantially flat because each bend forms the wire in a single plane; and three dimensional machines, in which the finished wire is more complex and may have bends defining multiple planes in space.

The wire bending machines known in the art generally include a wire feeding mechanism, a clamping mechanism, a bending mechanism, and a cutoff mechanism. The wire feeding mechanism feeds wire into the bending mechanism. Once the wire is in the correct position at the wire bending mechanism, the clamping mechanism secures the wire while the bending mechanism bends the wire. By repeating the steps of feeding the wire to a selected position and bending the wire to a selected angle, the wire bending machine creates an intricate series of bends in the wire. Three dimensional wire bending machines also include a means for rotating the wire relative to the bending mechanism. Certain known three dimensional wire bending machines include a means for rotating the bending mechanism relative to the wire. By rotating the wire or the bending mechanism, a three dimensional wire shape may be formed by changing the orientation of the wire relative to the bending mechanism at each bending location. This process is repeated until the wire has been bent into its final position. After the wire is bent into its final position, the cutoff mechanism cuts the wire.

In automated (e.g., CNC) wire bending machines, the wire feeding mechanism, clamping mechanism, means for rotating, bending mechanism, and cutoff mechanism are each driven by one or more actuators through a series of sequential operations defined in a part program. The actuators may be servo motors, stepper motors, hydraulic or pneumatic cylinders, or any other device that may be commanded electronically through circuits integrated with a computing device. Each actuator may further be associated with one or more feedback devices that provide position information associated with the respective actuator. These feedback devices might include encoders, resolvers, limit switches, proximity switches, or any other device that may provide position data electronically through circuits integrated with a computing device.

Known three dimensional wire bending machines generally have a limited range of rotation for the wire or the bending mechanism. This limited range of rotation typically results from designs in which cables or hoses related to the actuators or feedback devices restrict the rotation of the bending mechanism, or designs in which a mechanical element simply cannot be rotated beyond a certain range. It is desirable for automated wire bending machines to allow unlimited rotation of the wire or the bending mechanism.

Known wire bending machines generally use a cutoff mechanism that requires periodic replacement or sharpening, and which cuts the wire at a fixed location on the cutoff mechanism. These known cutoff mechanisms typically include a shearing device that is driven against the wire to cut the wire. The shearing device typically has a sharpened edge. A fixed point along the edge cuts the wire, and after multiple cuts the edge dulls such that the cutting mechanism requires more force to cut the wire and forms a less desirable end on the wire. Thus, because the shearing device degrades it is often designed to be replaceable or removable, requiring periodic maintenance. This maintenance is undesirable because it limits the productivity of the wire bending machine. In addition, in non-industrial environments, it may not be possible or desirable to require this type of maintenance. For example, when forming orthodontic wires, the wire bending machine may be installed at an orthodontist's office, which may not have staff or tools capable of replacing or sharpening the shearing device.

Further, the cutoff mechanism in the known wire bending machines is generally designed to be separate from the bending mechanism. This known design complicates the wire bending machine design by requiring control of an additional axis of motion, which requires a separate actuator and associated feedback devices along with computer hardware and software that coordinates the motion of the cutoff mechanism.

Known wire bending machines generally use a feeding mechanism separate from the clamping and rotating mechanisms. As discussed above, the separate inclusion of these mechanisms requires a separate actuator and associated feedback devices along with computer hardware and software that coordinates the motion of each mechanism. A simplified wire bending machine may be desirable, particularly for uses in which a wire bending machine is designed for non-industrial environments, where cost of the wire bending machine might outweigh the flexibility desired for large scale industrial production.

SUMMARY

Generally speaking and pursuant to these various embodiments, a bending machine is provided comprising a wire guide mechanism configured to receive a wire and a bending head. The bending head further comprises, an inner portion, wherein the inner portion includes a guide channel aligned with the wire guide mechanism, and an outer portion, wherein the outer portion includes a cutting edge and one or more bending pins. The outer portion is rotatable about the inner portion. The outer portion is movable from a first position to a second position in which the cutting edge is configured to engage and shear a wire extending through the wire guide mechanism and the guide channel. In one example the cutting edge is the outer circumference of the top surface of the outer portion. Because the outer portion is rotatable, there are multiple positions on the cutting edge that can be used to cut the wire. In another example the cutting edge is on a vertical surface of the outer portion such that the rotation of the outer portion causes the cutting edge to shear the wire. A second vertical surface of the outer portion may also include a cutting edge, allowing the wire to be cut from either side. Because the height of the bending head is adjustable, there are multiple positions on each cutting edge that can be used to cut the wire. Thus, both examples have the benefit of providing substantially longer tool life, which reduces the need for maintenance with respect to the cutting edge.

In one described example, the bending machine further comprises a control circuit. The control circuit is configured to store a history of at least one prior usage of the cutting edge in a memory accessible by the control circuit. In this example, the history of the prior usage of the cutting edge provides information relating to the sharpness of each cutting location along the cutting edge.

In another described example, the bending machine is further configured to determine a first position of the cutting edge relative to the wire. The first position may optionally be the position of the cutting edge at the completion of the wire part. In this example, the bending machine is further configured to select a second position different than the first position of the cutting edge based at least in part on the history of at least one prior usage of the cutting edge stored in a memory accessible by the control circuit. The bending machine is further configured to command the outer portion to rotate so that the second position is aligned with the clamping mechanism. In this example, the history of the prior usage of the cutting edge is used to select a position of the cutting edge according to one or more different approaches. In one alternative, the selected position may provide even wear on the cutting edge. In another alternative, the selected position may provide the sharpest possible location for cutting the wire. In another alternative, the selected position may optimize cycle time, by selecting a second position closest to the first position such that movement of the outer portion of the bending head is minimized. Other methods for selecting the second position may be employed without departing from the spirit of the disclosed example.

In another described example, the control circuit is further configured to determine that the first position of the cutting edge is dull based at least in part on the history of at least one prior usage of the cutting edge. In this example, the history of the prior usage of the cutting edge provides information about the cutting positions that are no longer viable for use. The determination of dullness of the cutting edge may be based on an absolute number of prior uses, or may alternatively be based on a relative number of prior uses in comparison to other positions along the cutting edge.

Generally speaking and pursuant to these various embodiments, a wire bending machine is provided comprising a bending head and a clamping mechanism further comprising a housing, a rotary shaft extending through the housing, two or more jaws coupled to the rotary shaft, a rotating jaw holder, and a jaw actuation bracket. The rotary shaft includes a channel and is rotatable within the housing. The rotating jaw holder encircles the two or more jaws and is supported by a bearing within a jaw actuation bracket. The bearing makes the rotating jaw holder free to rotate within the jaw actuation bracket. In particular, this design enables the jaws to rotate freely and without limit as to the amount of rotation. The jaw actuation bracket encircles the rotating jaw holder, and the jaw actuation bracket is movably coupled to the housing. The jaw actuation bracket is movable from a first position to a second position, wherein when the jaw actuation bracket is in the second position it urges the two or more jaws together. By moving the jaw actuation bracket from the first position to the second position, the clamping mechanism may provide a clamping force on a wire such that the wire is substantially fixed with respect to the two or more jaws of the clamping mechanism.

In one described example, the clamping mechanism further comprises one or more jaw actuation pins disposed on the rotating jaw holder. The one or more jaw actuation pins engage a jaw actuation pin slot formed within the two or more jaws such that when the jaw actuation bracket is in the second position the jaw actuation pin slot urges the jaws together.

In another described example, the clamping mechanism further comprises a motor mechanically coupled to the rotary shaft so as to rotate the rotary shaft and the rotating jaw holder. By operating the motor, a wire substantially fixed with respect to the two or more jaws of the clamping mechanism may be rotated with respect to a bending head on a wire bending machine.

Generally speaking and pursuant to these various embodiments, a system is provided comprising a CAD system configured to receive input from an input device, present a representation of a wire via a display device based on the input, create a wire shape based on the input, and transmit the wire shape to a bending machine. The bending machine is configured to receive the wire shape from the input device, and to manufacture a wire based on the wire shape. In one example, the wire is an orthodontic wire. In another example, the bending machine comprises features including the various embodiments disclosed herein such as the bending head and the clamping mechanism discussed above.

In addition to the above-mentioned embodiments, it should be understood that a variety of methods are also disclosed herein. For example, pursuant to these various embodiments a method of manufacturing a wire is provided comprising receiving an input from an input device, presenting a representation of a wire via a display device based on the input, creating a wire shape based on the input, transmitting the wire shape to a bending machine via a communications network, and manufacturing a wire based on the wire shape by the bending machine.

These and other methods related to the subject matter set forth herein are intended to be covered by this disclosure. It should also be understood that while certain features have been described with certain embodiments, these features may be intermixed or interchanged with one another to form other embodiments as desired. All features disclosed herein are intended to be used in any of the embodiments disclosed herein either in lieu of similar features or in combination with other features.

The disclosed simplified wire bending machine may be optimized for non-industrial environments. For example, such wire bending machines may be used to form orthodontic wires in an orthodontist's office, where tools and persons with mechanical aptitude may not be available. Pursuant to the various embodiments disclosed herein, the simplified wire bending machine may be a relatively smaller device, designed for table-top operation. Features and concepts disclosed herein apply equally to wire bending machines used in industrial environments on machines of relatively larger size.

BRIEF DESCRIPTION OF THE DRAWINGS

This description includes drawings, wherein.

DETAILED DESCRIPTION

As previously discussed, current wire bending machines are limited in the manner in which they can manipulate and cut wire. Embodiments of the inventive subject matter include a bending machine that has a greater ability to manipulate wire while bending. Additionally, embodiments of the inventive subject matter include a bending machine that has additional flexibility in cutting wire after it is bent. The bending machines described herein can be modified for use with any type (e.g., material, shape, etc.) of wire and any size (e.g., gauge) wire). FIG. 1 and the related text provide a broad overview of an example wire bending machine, according to some embodiments of the inventive subject matter. Additionally, bending machines similar to those described herein can be used to automate the manufacture of bent wire, as discussed in more detail with respect to FIGS. 10 and 11.

Figure 1A:
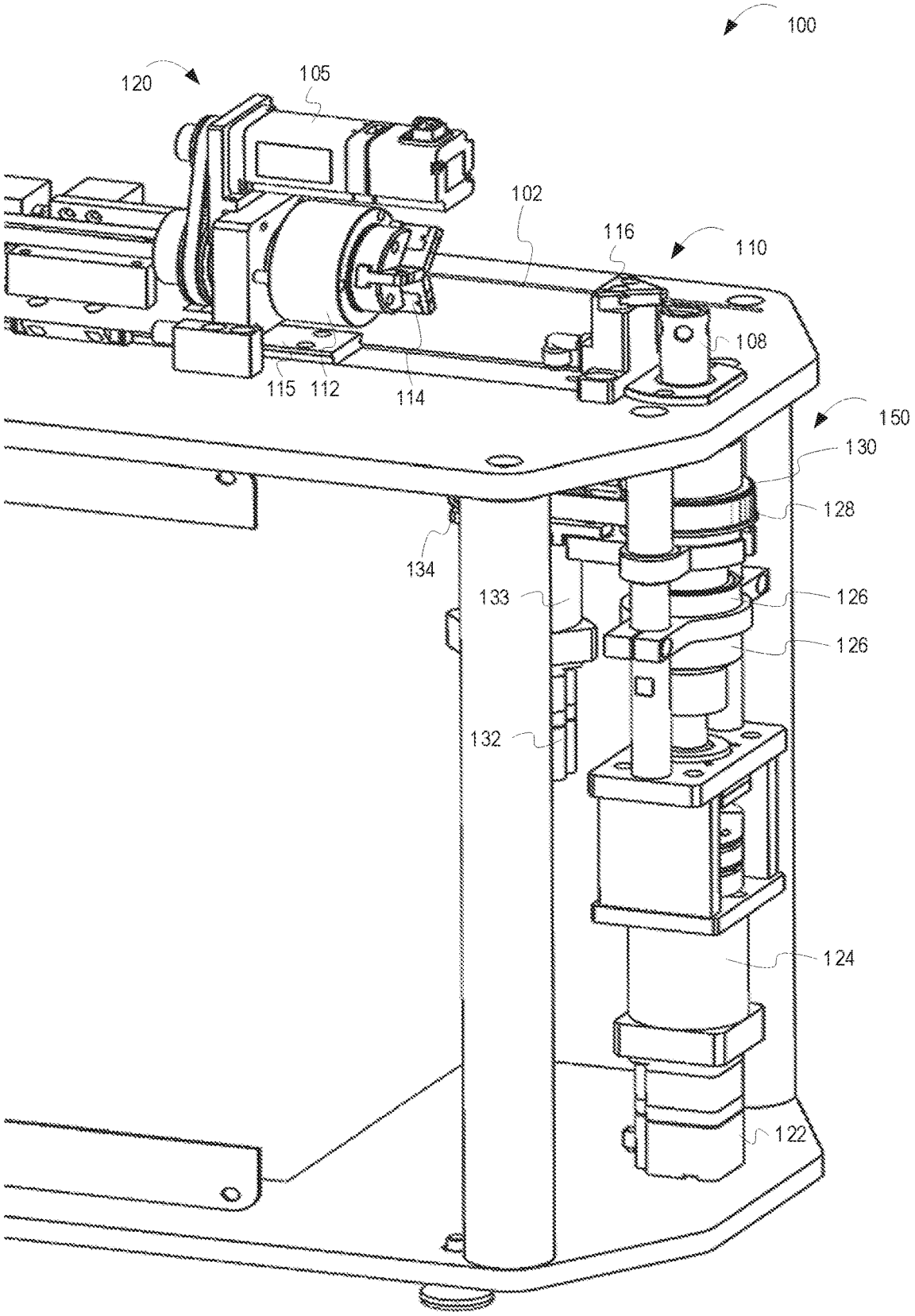
FIG. 1A is an isometric view of a bending machine 100, according to some embodiments of the inventive subject matter.

FIG. 1A is an isometric view of a bending machine 100, according to some embodiments of the inventive subject matter. The wire bending machine 100 includes a wire feeding and clamping mechanism 120, a wire guide 116, and a bending head 110. The clamping mechanism 120 secures a wire 106 while the bending head 110 bends the wire 106. The clamping mechanism 120 secures the wire 102 via jaws 114. The example bending machine 100 depicted in FIG. 1 includes three jaws 114, although other configurations are possible (e.g., a different number of jaws 114 may be desirable based on qualities of the wire 106, such as shape, size, material, etc.). The clamping mechanism 120 is operable to manipulate the wire 106, for example by rotating and advancing the wire 102. To rotate the wire 102, the clamping mechanism 120 includes a motor 106 that rotates the jaws 114. Such rotation allows the wire bending machine 100 to create bends in the wire 100 in any plane. To advance the wire, the clamping mechanism 120 is slidably mounted on a track 115. By clamping the wire 106 in the jaws 114, the clamping mechanism grasps the wire 102. To advance the wire, the clamping mechanism 120 is driven towards the bending head 110 while the wire is grasped in this manner. At the limit of the clamping mechanism's slidable travel, a pin in the wire guide 116 (illustrated in FIG. 4B and described below) secures the wire 102 while the clamping mechanism 120 releases the wire 105 by retracting the jaws 114 before the clamping mechanism 120 retracts away from the bending head 110. In one embodiment, the clamping mechanism retracts away from the bending head prior to loading a new wire to increase the amount of wire it can feed before arriving at the limit of the clamping mechanism's slidable travel. An embodiment of the clamping mechanism 120 is described in greater detail with reference to FIGS. 6-9.

The bending head 110 may be raised or lowered, and includes a rotatable outer portion 108. The outer portion 108 includes a cutting edge along the outer circumference of its top surface. The bending head 110 is movable in the vertical direction. Movement of the outer portion 108 in the vertical direction causes the outer portion 108 to extend toward and through the wire 102. The cutting edge of the outer portion 108 shears the wire 106 when the cutting edge pass through the wire 106. Embodiments of the bending head 110 are described in greater detail with reference to FIGS. 2-5.

The outer portion 108 rotates about the inner portion to bend the wire 102. The bending head 110 is driven by a bending head drive mechanism 150. The bending head drive mechanism 150 includes a first motor 122, a gearbox 124, one or more guide bearings 126, a second motor 132, a drive pulley 134, a driven pulley 130, and a belt 128. The first motor 122 drives vertical movement of the bending head 110. The first motor is (optionally) coupled to the gearbox 124 to more accurately control movement of the bending head 110. For example, the gearbox 124 can include a reduction gear. The first motor 122 drives a threaded shaft (e.g., the threaded shaft 136 depicted in FIG. 1B) that causes linear motion of a ball screw (e.g., the ball screw 138 depicted in FIG. 1B). The bending head 110 is seated on the ball screw. Consequently, rotation of the threaded shaft causes vertical movement of the ball screw as well as the bending head 110 seated on the ball screw. The motor 122 is preferably servo-controlled, but may also be a stepper.

The bending head drive mechanism 150 also drives rotational motion of the outer portion 108 to bend the wire 102. Specifically, the second motor 132 is mechanically coupled via a gearbox 133 to the drive pulley 134. A belt 128 couples the drive pulley 134 to the driven pulley 130. The outer portion 108 of the bending head 110 is coupled to the driven pulley 130 such that rotational motion of the second motor 132 causes rotational motion of the outer portion 108. The motor 132 is preferably servo-controlled, but may also be a stepper.

Figure 1B:
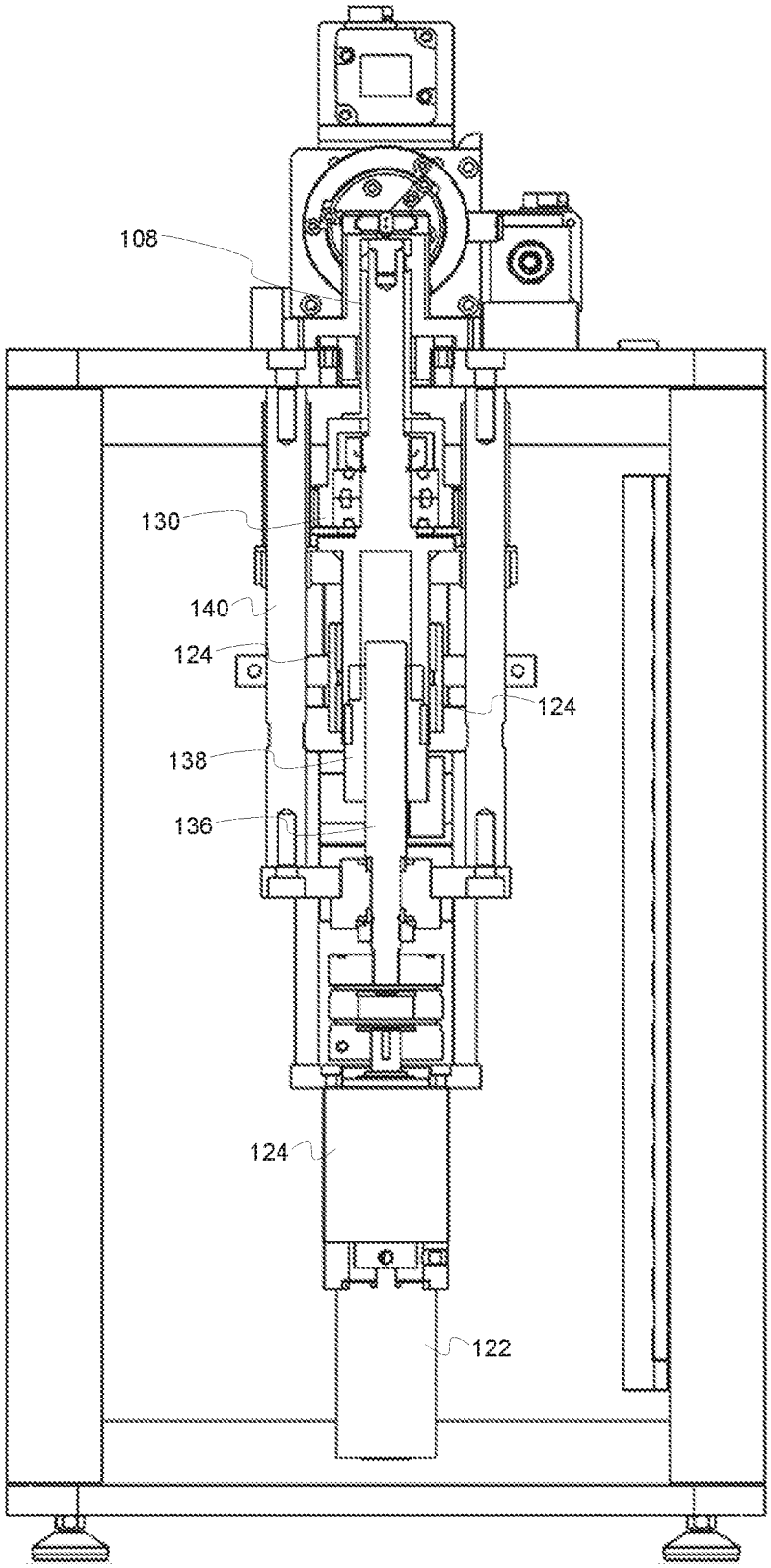
FIG. 1B is a sectional view of a bending head drive mechanism, according to some embodiments of the inventive subject matter.

FIG. 1B is a sectional view of a bending head drive mechanism, according to some embodiments of the inventive subject matter. As can be seen in FIG. 1B, the first motor 122 is coupled to the threaded shaft 136 via the gearbox 124. Rotational motion of the first motor 122 causes the threaded shaft 136 to rotate and thus causes vertical movement of the ball screw 138. The bending head (e.g., the bending head 110 of FIG. 1A) rides on the ball screw 138. Consequently, vertical movement of the ball screw 138 causes vertical motion of the bending head. One or more guide bearings 126 provide support for the threaded shaft 136 by bracing the threaded shaft 136 with respect to one or more vertical supports 140.

While FIGS. 1A and 1B depict an example bending machine, FIGS. 2-5 depict an embodiment of the bending head mechanism in greater detail. Common elements in the drawing figures are labeled with like numbers.

Figure 2:
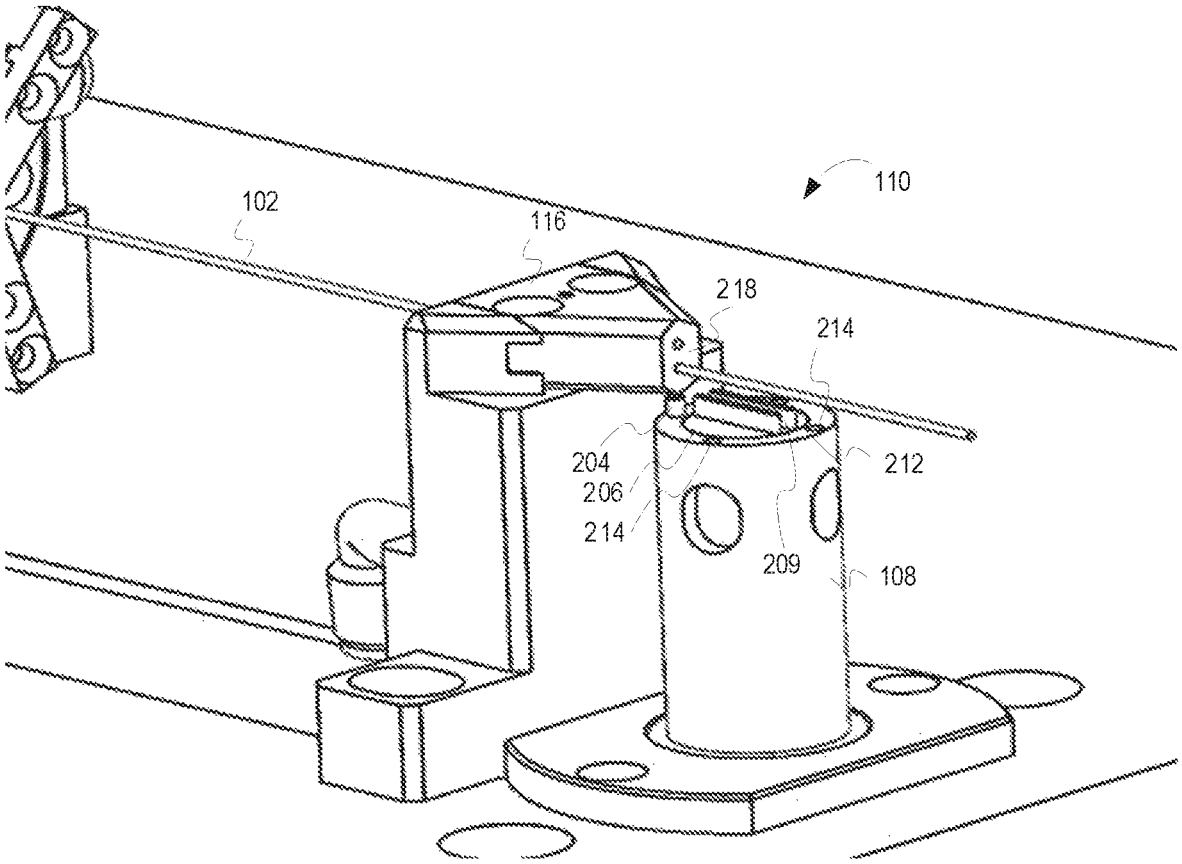
FIG. 2 is an isometric view of a bending head 200 of a bending machine, according to some embodiments of the inventive subject matter.

FIG. 2 is an isometric view of a bending head 110 of a bending machine, according to some embodiments of the inventive subject matter. The bending head 110 includes an outer portion 108 and an inner portion 206. The outer portion 108 is positioned around the inner portion 206. The outer portion 108 includes a cutting edge 212 and one or more pin receivers 214. Some or all of the pin receivers 214 house bending pins 204. The inner portion 206 includes a guide channel 209. The guide channel 209 receive wire 102 and holds the wire 102 in position during bending. The outer portion 108 and the inner portion 206 are illustrated in a retracted position to allow a clear view of the wire guide 116. A front face 218 of the wire guide 116 is the cutoff location. When the outer portion 108 moves upwards, the edge 212 shears the wire 102 at this cutoff location 218. The outer portion 108 rotates about the inner portion 206, as best depicted in FIG. 3.

Figure 3:
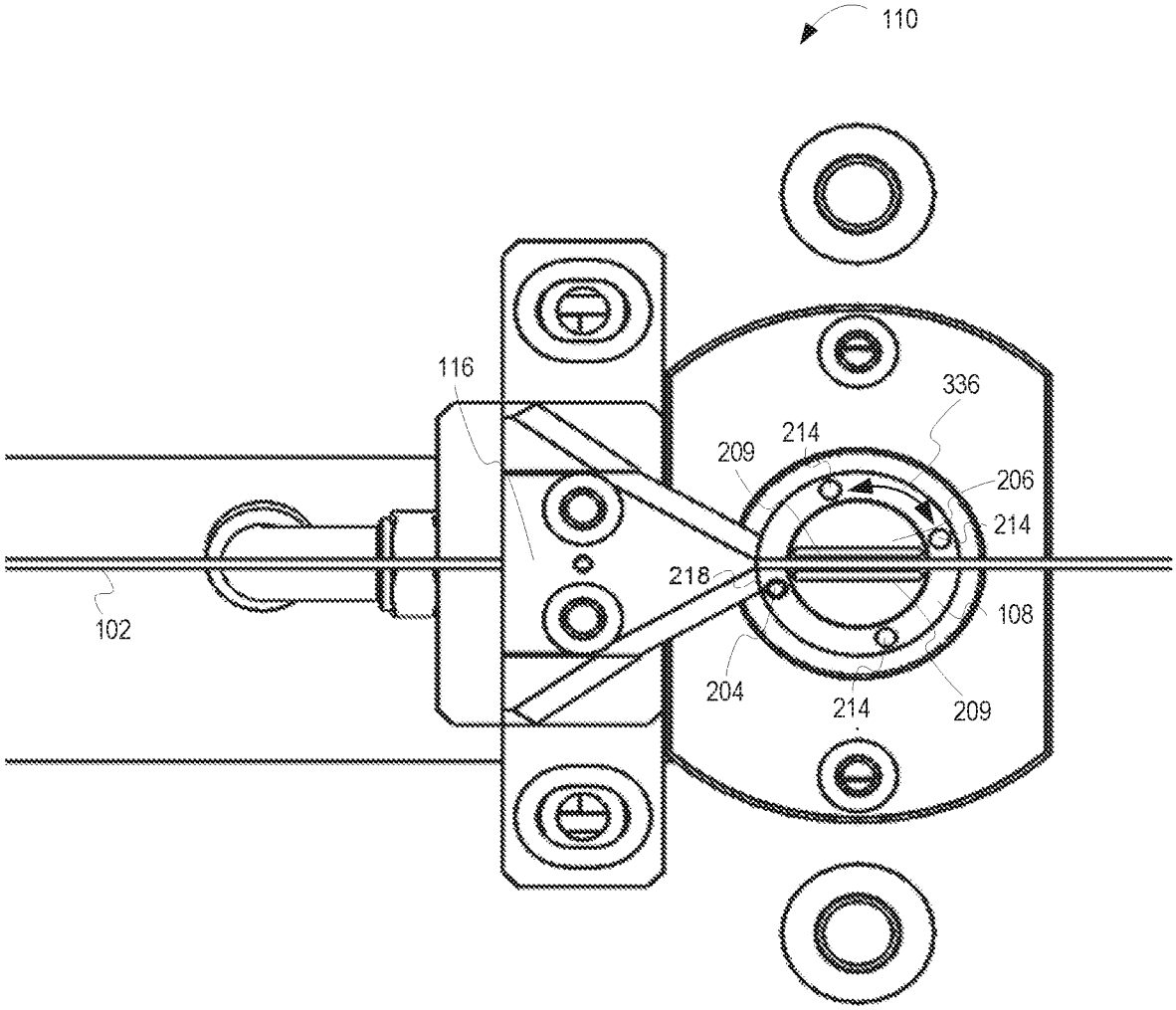
FIG. 3 is a top view of a bending head 300 of a bending machine, according to some embodiments of the inventive subject matter.

FIG. 3 is a top view of a bending head 110 of a bending machine, according to some embodiments of the inventive subject matter. The outer portion 108 rotates about the inner portion 206, as indicated by the arrows 336. During rotation, the bending pin 204 engages the wire 102 and bends the wire 102 against the guide channel 209. As illustrated in this view, the wire guide 116 aligns the wire 102 with the guide channel 209 in the inner portion 206 of the bending head.

Figure 4A:
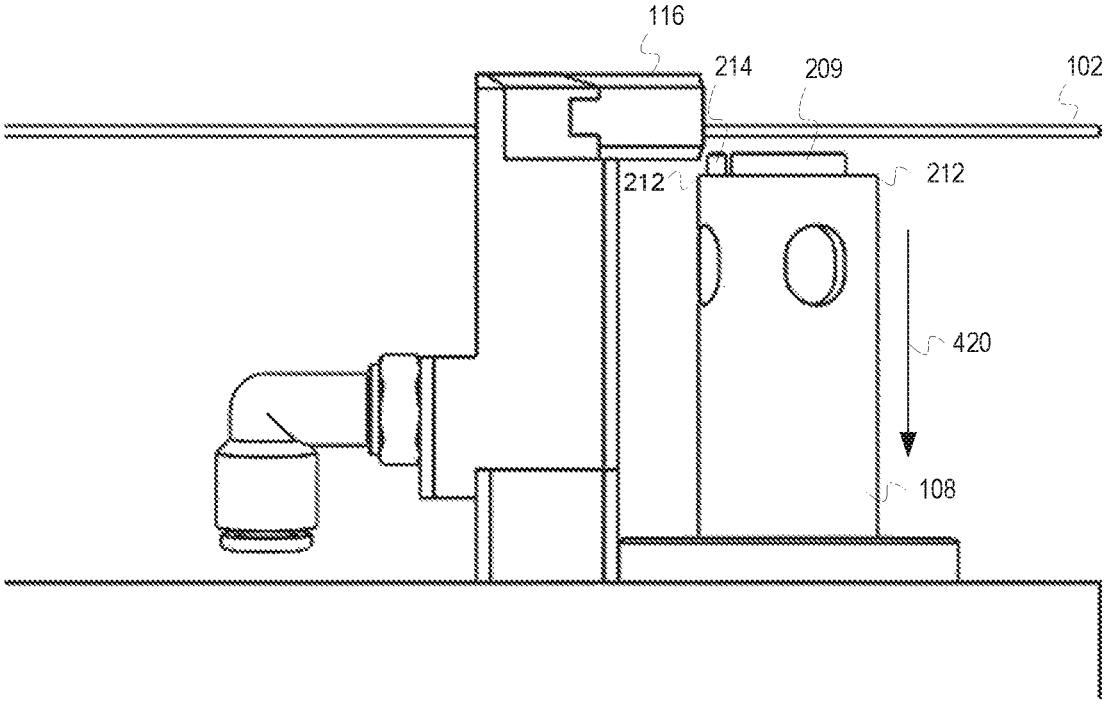
FIG. 4A is a side view of a bending head of a bending machine in a fully retracted position, according to some embodiments of the inventive subject matter.

FIG. 4A is a side view of a bending head of a bending head 110 in a fully retracted position, according to some embodiments of the inventive subject matter. When in the fully retracted position, the inner portion 206 and the outer portion 108 are retracted below the wire 102. Consequently, neither the guide channel 209, nor the bending pin 214, nor the cutting edge 112 engage the wire 102. Both the inner portion and the outer portion 108 are extendable and retractable in the vertical direction, as indicated by the arrow 420.

Figure 4B:
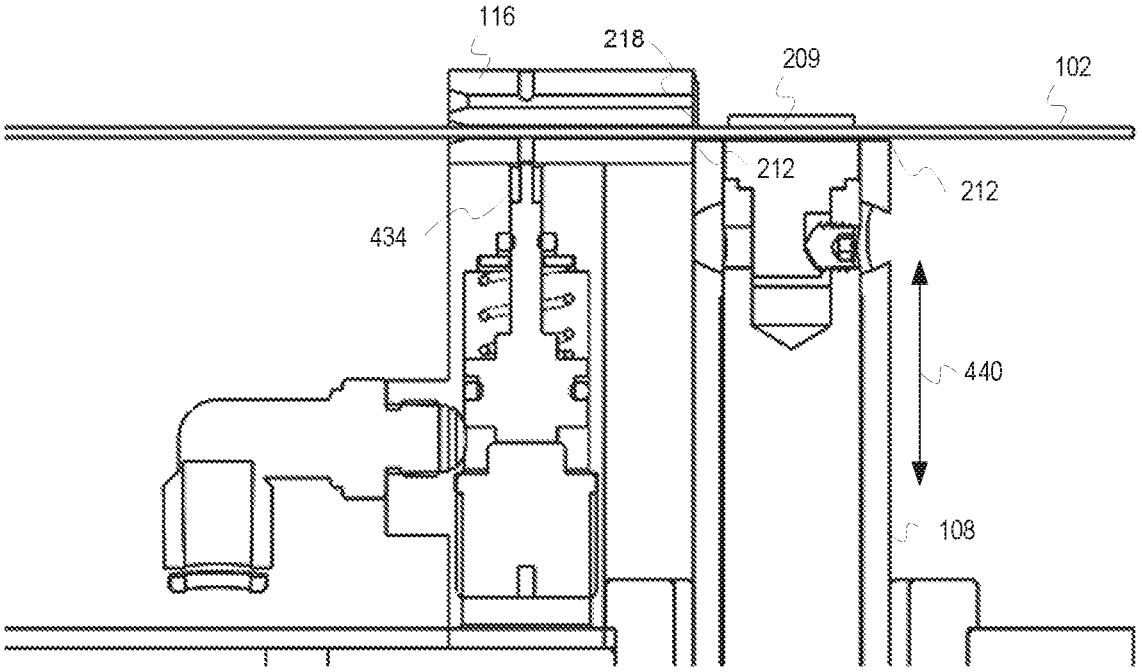
FIG. 4B is a sectional view of a bending head of a bending machine in a first position, according to some embodiments of the inventive subject matter.

FIG. 4B is a sectional view of a bending head of a bending head 110 in a first position, according to some embodiments of the inventive subject matter. During bending, the outer portion 108 is retracted so that the cutting edge 212 does not engage the wire 102. While in the first position, the guide channel 209 is aligned (i.e., vertically) with the clamping mechanism 436 so that the wire 402 extends through the wire guide 116 and the guide channel 209. When in the first position, a bending pin 214 (not shown) is positioned so as to be able to bend the wire 102. Both the inner portion 206 and the outer portion 108 are movable in the vertical direction, as indicated by the arrow 440. The wire guide 116 includes a movable mechanism (e.g., a pin 434) that engages and holds the wire 102 during bending and/or repositioning of the wire 422. In the illustrated embodiment, the pin 434 is driven by a pneumatic cylinder, but other methods of driving the pin would be apparent to a person skilled in the art, including hydraulic or solenoid driven devices.

Figure 5:
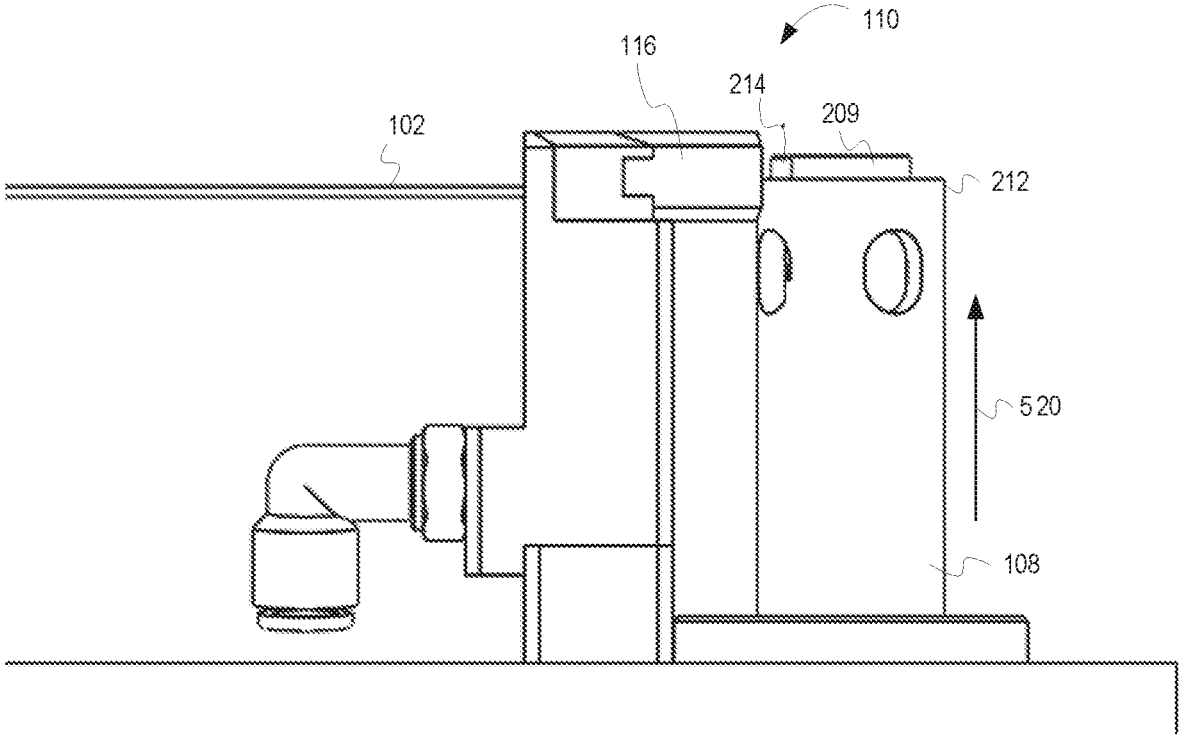
FIG. 5 is a side view of a bending head of a bending machine in a second position, according to some embodiments of the inventive subject matter.

FIG. 5 is a side view of a bending head 110 of a bending machine in the second position, according to some embodiments of the inventive subject matter. To cut the wire 102, the outer portion 108 moves from the first position upwardly to the second position, as indicated by the arrow 520. As the outer portion 108 advances toward the second position, the outer portion 518 extends beyond the inner portion such that the cutting edge 212 contacts the wire 102. The cutting edge 212 shears the wire 102 at the cutoff location 218 the wire 102. Because the outer portion 108 has a circular cross section, the cutting edge 212 is not linear. Rather, the cutting edge 212 is curved. In some embodiments, the diameter of the cross section of the outer portion 108 can be chosen to complement the size of the wire 102. For example, an outer portion 108 with a large diameter can be chosen to cut a large wire 102 so that the apparent curvature of the cutting edge 212 is minimized. In some embodiments, the diameter of the outer portion 108 and the size of the wire 102 are such that the curvature of the cutting edge 212 is negligible (i.e., the cutting edge appears to be linear throughout the width of the wire).

In some embodiments, the bending machine stores a history of the usage of the cutting edge 212. For example, the bending machine records locations on the cutting edge 212 that are used to cut the wire 102. Specifically, a control circuit associated with the bending machine tracks the number of times each location of the cutting edge 212 is used. The bending machine logs this information to monitor wear of the cutting edge 212. Additionally, in some embodiments, the bending machine rotates the outer portion 108 before cutting the wire to ensure that a sharp portion of the cutting edge 212 is used to cut the wire. For example, if the log indicates that a portion of the cutting edge 212 has been used a sufficient number of times to become dull, the bending machine rotates the outer portion 212 before cutting the wire 102. Further, if the log indicates that all portions of the cutting edge 212 have been used a sufficient number of times to become dull, the bending machine alerts a user that attention is required. For example, the bending machine alerts the user to replace the bending head 110, outer portion 108, or cutting edge 212, or recommend that the cutting edge 212 be sharpened.

Figure 12A:
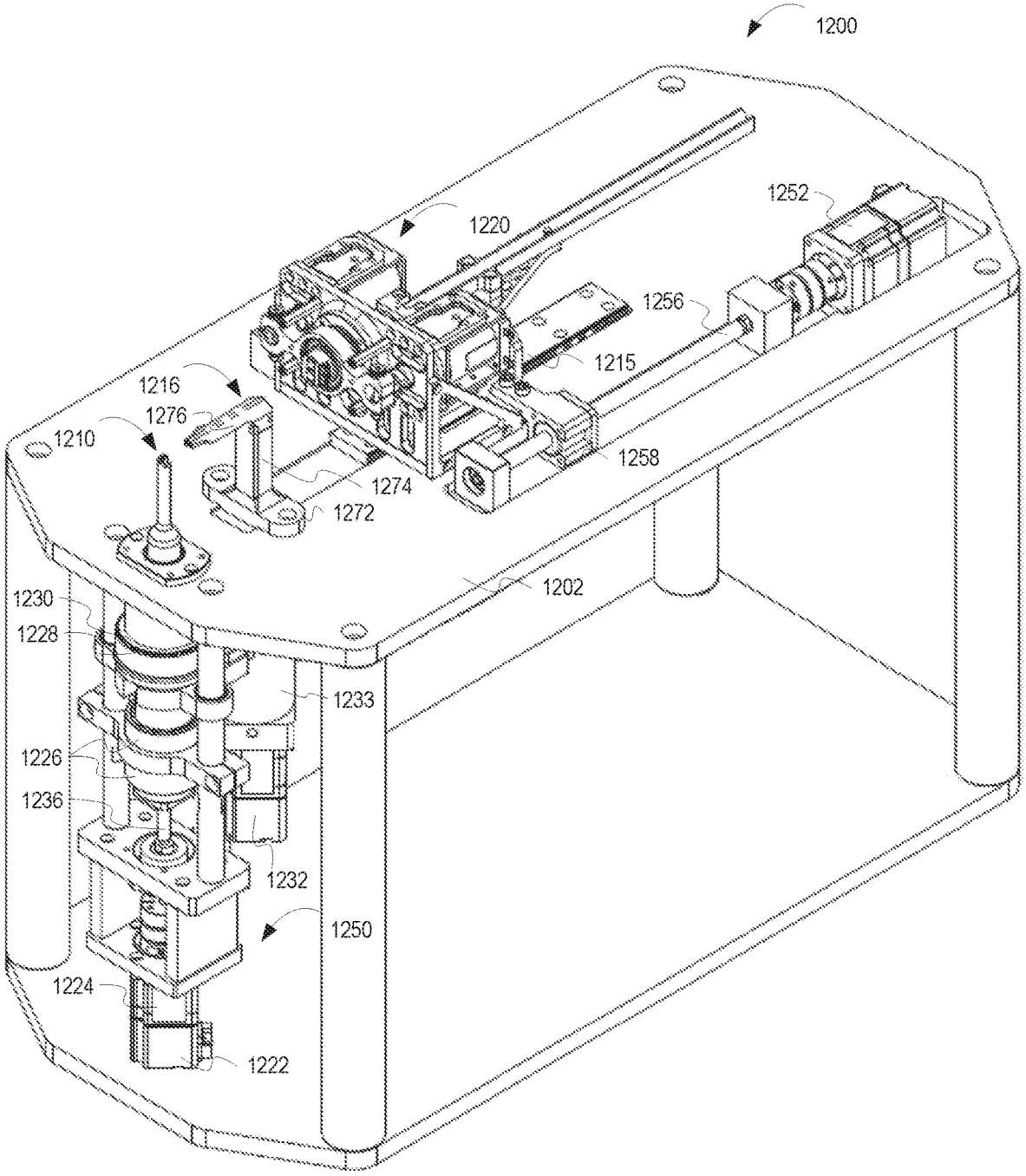
FIG. 12A is an isometric view of a bending machine 1200, according to some embodiments of the inventive subject matter.

FIG. 12A is an isometric view of an alternative embodiment of a bending machine 1200. The wire bending machine 1200 includes a plate 1202 upon which is mounted a wire feeding and clamping mechanism 1220, a wire guide 1216, and a bending head 1210. The clamping mechanism 1220 secures a wire (not illustrated in FIG. 12) while the bending head 1210 bends the wire 106. The clamping mechanism 120 is a two-jaw design substantially similar to the mechanism illustrated in FIGS. 6-9. To advance the wire, the clamping mechanism 1220 is slidably mounted on a track 1215. A motor and gearbox 1252 is also mounted on the plate 1202, and drives a leadscrew 1256 that drives the nut 1258 when the motor turns. The motor 1252 is preferably servo-controlled, but may also be a stepper. As in FIG. 1, the clamping mechanism 1220 advances the wire by clamping the wire before it drives towards the bending head 1210. To adjust the position of the clamping mechanism 1220 relative to the wire a pin in the wire guide 1216 (similar to the mechanism illustrated in FIG. 4B and described below) secures the wire and the clamping mechanism 1220 releases the wire before the clamping mechanism 1220 retracts away from the bending head 1210 or advances toward the bending head. Similar to the bending machine illustrated in FIG. 1, the clamping mechanism may retract away from the bending head prior to loading a new wire to increase the amount of wire it can feed before arriving at the limit of the clamping mechanism's slidable travel.

The wire guide 1216 includes a vertical neck 1274 extending from a base 1272 that is mounted to the plate 1202. A nose 1276 extends from the top of the neck 1274 toward the bending head 1210. By incorporating an elongated nose 1276, the wire guide provides ample clearance to wires being formed by the bending head 1210. Wire shapes formed at the bending head 1210 may include bends that direct the wire back from the bending head 1210 toward the wire guide 1216. The nose 1276 has a thin profile designed to encourage the wire to pass over or under the wire guide 1216, in the event the wire reaches the wire guide 1216.

In one embodiment (not illustrated), the wire guide 1216 is slidably mounted on the plate 1202. In this embodiment, the track 1215 extends toward the bending head 1210 and the base 1272 is slidably mounted on the track 1215. Because it is slidable, the wire guide 1216 can be adjusted to positions closer or farther from the bending head 1210. The wire guide 1216 may be manually adjustable with set screws or pints to hold a desired position, or may be driven by a motor and leadscrew in the same fashion as the clamping mechanism 1220. Alternatively, a pneumatic cylinder, belt drive, rack and pinion, or other mechanism may be used to drive the wire guide 1216.

Figure 12B:
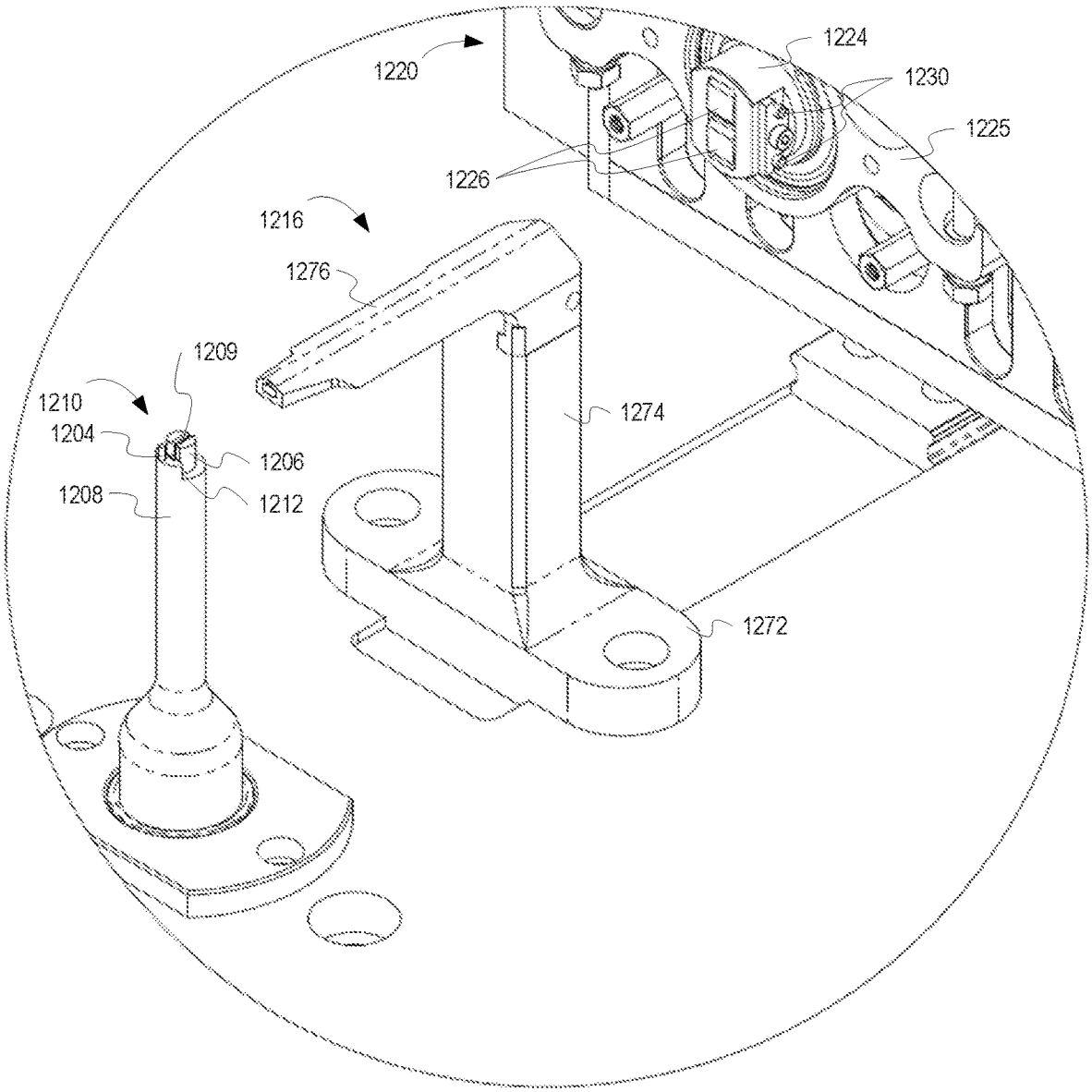
FIG. 12B is a detail isometric view of the bending head, wire guide, and clamping mechanism of the bending machine 1200.

Similar to the bending machine illustrated in FIG. 1, the bending head 1210 may be raised or lowered, and includes a rotatable outer portion 1208 (illustrated in FIG. 12B). A bending head drive mechanism 1250 accomplishes both functions. A first motor 1222 raises and lowers the bending head 1210. The motor 1222 is coupled to a threaded shaft 1236 via a gearbox 1224. Rotational motion of the first motor 1222 therefore causes the threaded shaft 1236 to rotate and thus causes vertical movement of the bending head 1210. The motor 1222 is preferably servo-controlled, but may also be a stepper. The bending head 1210 rides on a threaded nut (not illustrated) and is supported by guide bearings 1226 in the same fashion as the device illustrated in FIG. 1. Alternatively, a pneumatic or hydraulic cylinder may be used to raise and lower the bending head 1210.

The bending head drive mechanism 1250 also drives rotational motion of the outer portion 1208 to bend and cut the wire. Specifically, the second motor 1232 is mechanically coupled via a gearbox 1233 to the drive pulley (not illustrated, but similar to 134 in FIG. 1A). A belt 1228 couples the drive pulley to the driven pulley 1230. The outer portion 1208 of the bending head 1210 is coupled to the driven pulley 1230 such that rotational motion of the second motor 1232 causes rotational motion of the outer portion 1208. The motor 1232 is preferably servo-controlled, but may also be a stepper.

FIG. 12B is a detail view of the bending head 1210, wire guide 1216, and wire feeding and clamping mechanism 1220. The clamping mechanism 1220 includes a rotating jaw holder 1204 that secures two jaws 1226. The jaws 1226 each include a slot that follows a pin 1230 within the rotating jaw holder such that when the jaw actuation bracket 1225 thrusts the rotating jaw holder 1230 toward the bending head 1210, the jaws 1226 clamp together on the wire. When the jaw actuation bracket 1225 thrusts the rotating jaw holder 1230 away from the bending head 1210, the jaws 1226 release the wire. The clamping mechanism 1220 is similar to the mechanism described in greater detail with respect to FIGS. 6-9.

The bending head 1210 includes an inner portion 1206 and an outer portion 1208. The outer portion 1208 is rotatable around the inner portion. A wire channel 1209 receives the wire such that the bending pin 1204 may bend the wire around inner portion 1206 when the outer portion 1208 rotates. The outer portion 1208 also includes a cutoff 1212, which is described in greater detail in FIG. 12C.

Figure 12C:
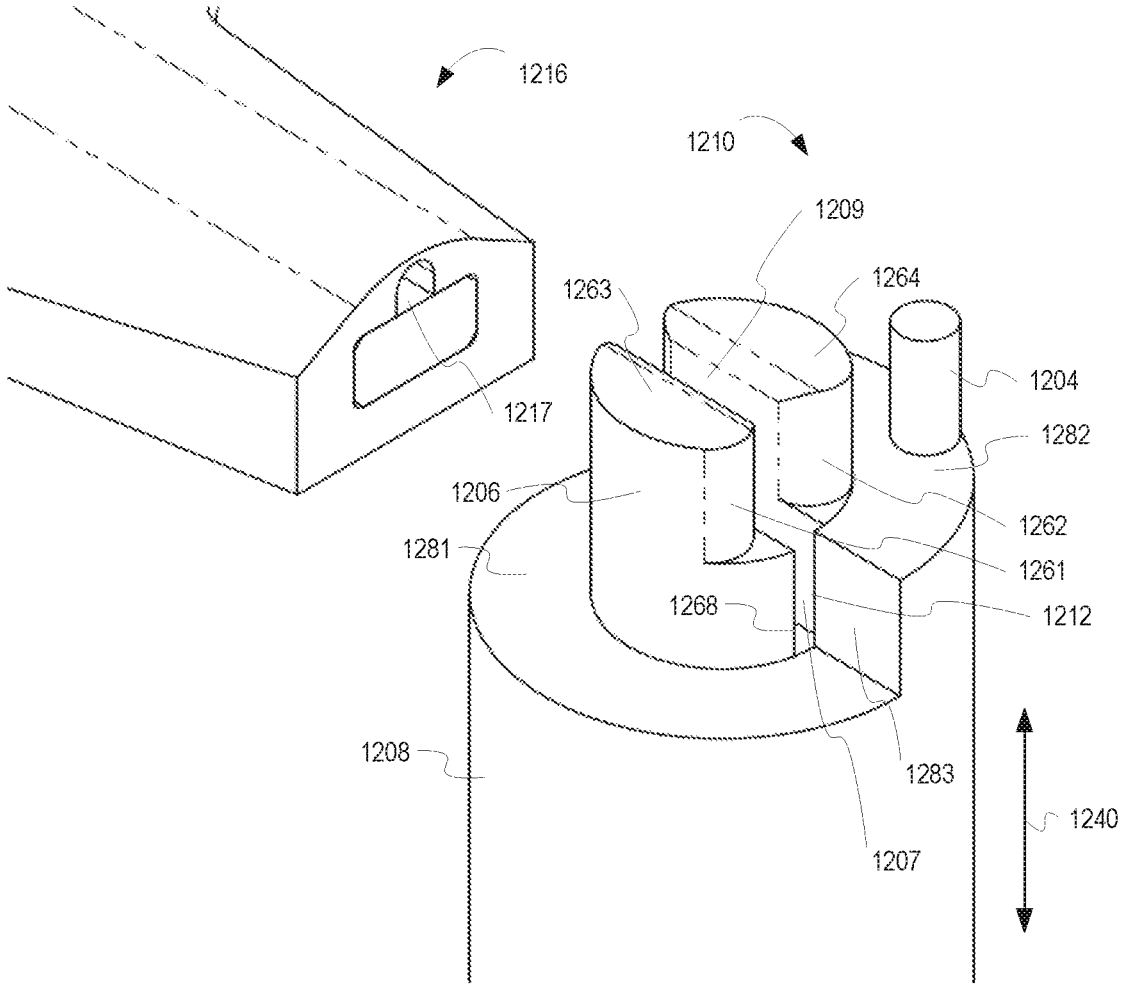
FIG. 12C is a detail isometric view of the bending head and wire guide of the bending machine 1200.

FIG. 12C is a detail view of the bending head 1210 and the nose of the wire guide 1216. The outer portion 1208 includes a stepped top surface. The bottom step 1281 encompasses more than half of the circumference of the outer portion 1208. The upper step 1282 encompasses the remaining portion of the circumference of the outer portion 1208. A bending pin 1204 extends vertically from the upper step 1282. When the outer portion 1208 of the bending head 1210 rotates, the bending pin 1204 bends the wire around the bending surfaces 1261 and 1262 of the inner portion 1206.

The inner portion 1206 includes a wire bending channel 1209 in the portion of the inner portion 1206 above the upper step 1282. The inner portion 1206 further includes a wire cutting channel 1207 below the upper step 1282 and above the bottom step 1281. Both the wire cutting channel 1207 and the wire bending channel 1209 are sized to fit the wire, and the wire bending channel 1209 is open into the wire cutting channel 1207. Thus, the vertical position of the bending head 1210 determines whether the wire extends through the bending channel 1209 or the cutting channel 1207. The wire guide 1216 includes a hole 1217 through which the wire protrudes. Because the wire guide 1216 does not move vertically, the wire is held at a fixed height relative to the bending head 1210, which moves vertically as shown by the arrow 1240.

The inner portion 1206 of the bending head 1210 is divided by the bending channel 1209 and the cutting channel 1207 such that two bending/cutting dies 1263 and 1264 protrude vertically from the inner portion 1206. The inner surfaces of the bending channel are preferably flat, and intersect tangentially with the bending surfaces 1261 and 1262. The bending surfaces 1261 and 1262 have a radius that determines the inner radius of a wire bent around the bending surfaces. The respective bending surfaces 1261 and 1262 may have different radii to facilitate flexibility in the wire bending operations performed by the bending machine 1200. By rotating the wire using the clamping mechanism 1220 the bending machine 1200 can selectively use either bending surface for any given bend. The inner surfaces of the cutting channel 1207 are preferably flat, and intersect to form a sharp edge 1268 at the outer edge of the inner portion 1206. The outer portion includes a vertical face 1283 between the bottom step 1281 and the upper step 1282, with a cutting edge 1212. If the bending head 1210 is positioned such that the wire is in the cutting channel, the cutting edge 1212 of the outer portion 1208 shears the wire against the sharp edge 1268 of the inner portion 1206 when the outer portion 1208 rotates the vertical face 1283 past the cutting channel 1207. A second vertical surface (not shown) exists at the opposite side of the upper step 1281, and may also include a cutting edge. Similarly, every intersection of the cutting channel 1207 and the outer surface of the inner portion 1206 includes a corresponding sharp edge and may be used to cut the wire. Thus, the bending head 1210 has multiple surfaces at which the wire may be cut.

In some embodiments, the bending machine stores a history of the usage of the cutting edge 1212. By adjusting the vertical height of the bending head 1210, different parts of the cutting edge 1212 and 1268 may be used to shear the wire. Further, the wire bending machine 1200 may use different edges on the cutting head 1210, as described above. Thus, the bending machine can select different locations for shearing the wire. Similar to the embodiment illustrated in FIGS. 1-5, the bending machine 1200 records the number of times each location on the cutting edge 1212 is used to cut the wire. For example, a control circuit associated with the bending machine can track the usage of different locations along the cutting edge 1212. The bending machine can log this information to monitor wear of the cutting edge 1212. If the log indicates that a portion of the cutting edge 1212 has been used a sufficient number of times to become dull, the bending machine can adjust the vertical height of the bending head 1210 before cutting the wire. Further, if the log indicates that all portions of the cutting edge 1212 have been used a sufficient number of times to become dull, the bending machine can alert a user that attention is required. For example, the bending machine could alert the user to replace the bending head 1210, outer portion 1208, or cutting edge 1212, or recommend that the cutting edge 1212 be sharpened.

Figure 13:
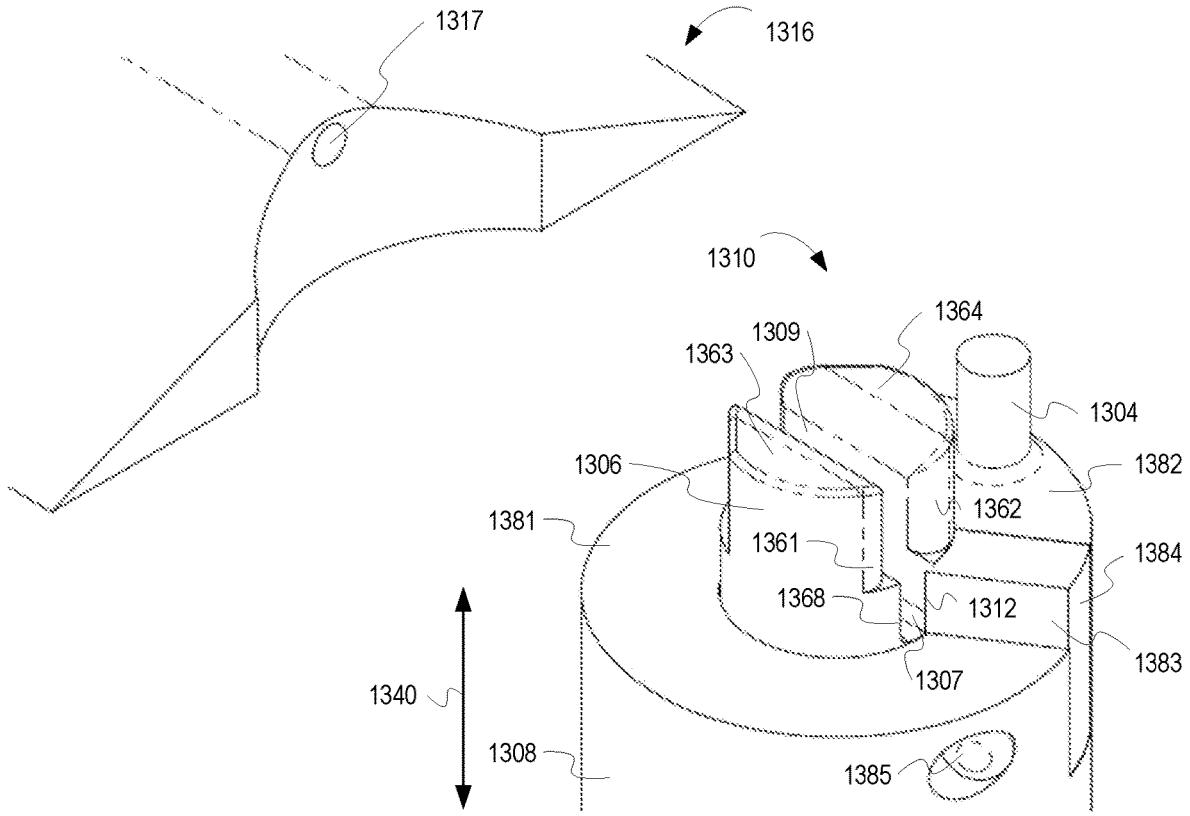
FIG. 13 is a detail isometric view of an alternative embodiment of the bending head.

FIG. 13 is a detail view of an alternative embodiment of the bending head 1310. Similar to the embodiment illustrated in FIG. 12, the bending head 1310 includes an outer portion 1308 having a bottom step 1381 and an upper step 1382. A bending pin 1304 extends upwardly from the upper step 1382. The inner portion 1306 includes two bending/cutting dies 1363 and 1364 that define a bending channel 1309 and a cutting channel 1307. The bending channel 1309 has substantially flat inner surfaces that intersect with bending surfaces 1361 and 1362 upon which a wire can be bent. The cutting channel 1307 includes a sharp edge 1368 against which the wire may be sheared. The bending head 1310 is adjustable vertically as shown by the arrow 1340 such that a wire protruding from the wire guide 1316 through the hole 1317 will extend through either the bending channel 1309 or the cutting channel 1307.

In addition to the features described above, the bending head 1310 includes a cutting insert 1384 seated between the bottom step 1381 and the upper step 1382 such that a vertical surface 1383 of the cutting insert 1384 includes a cutting edge 1312 used to shear the wire. As would be known to a person having ordinary skill in the art, the cutting insert 1384 comprises hardened steel or other material and may comprise a hardened coating to improve the wear life of the cutting edge 1312. The cutting insert 1384 is secured in place by a screw 1385 that threads through the cutting insert 1384 and into the outer portion 1308.

Figure 14:
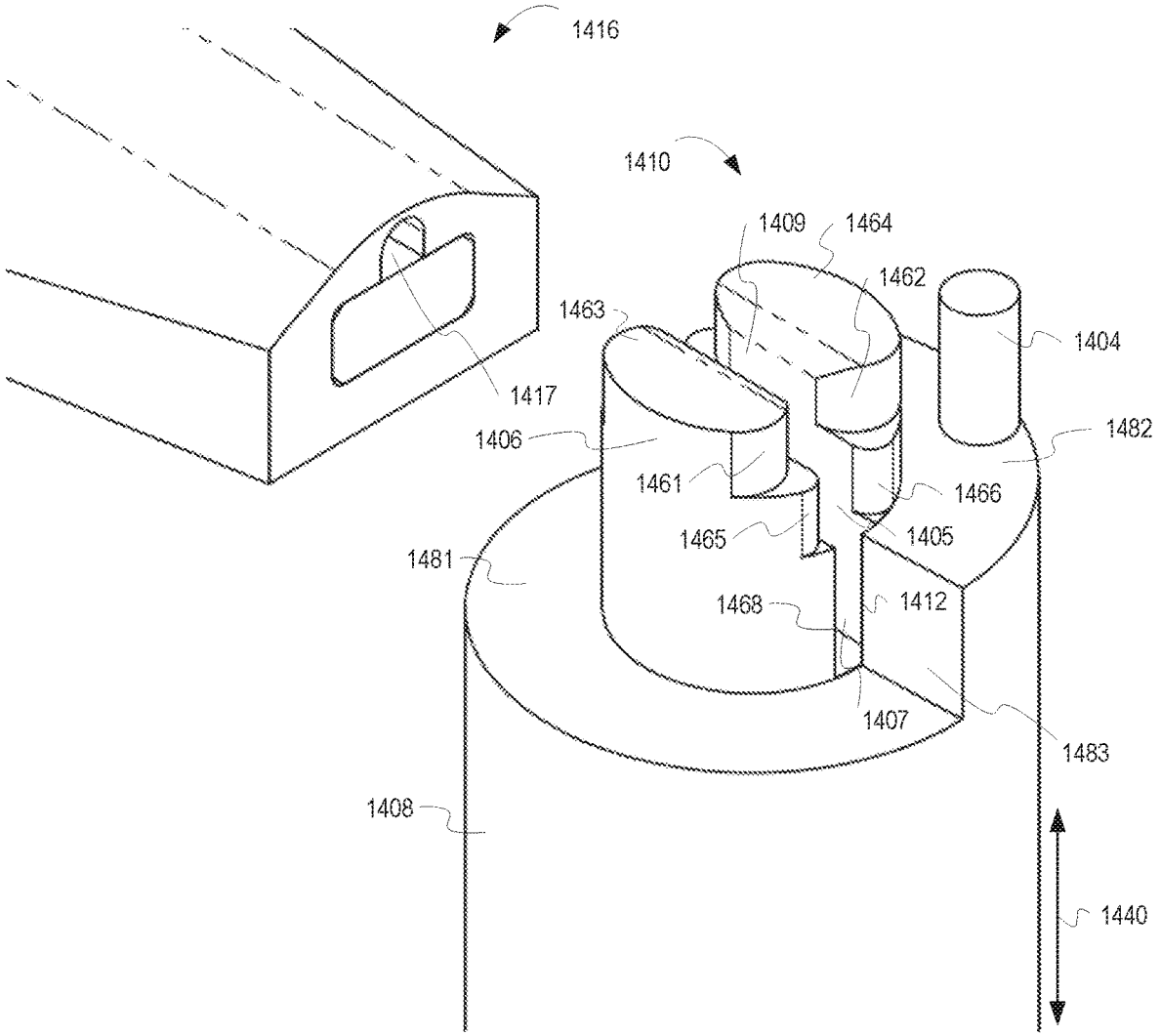
FIG. 14 is a detail isometric view of an alternative embodiment of the bending head.

FIG. 14 is a detail view of an alternative embodiment of the bending head 1410. Similar to the embodiment illustrated in FIGS. 12 and 13, the bending head 1410 includes an outer portion 1408 having a bottom step 1481 and an upper step 1482. A bending pin 1404 extends upwardly from the upper step 1482. The inner portion 1406 includes two bending/cutting dies 1463 and 1464. In contrast to the other embodiments, the bending/cutting dies 1463 and 1464 define both a first bending channel 1409, a second bending channel 1405, and a cutting channel 1407. As before, both bending channels 1409 and 1405 have substantially flat inner surfaces. The bending surfaces 1465 and 1466 have different radii than bending surfaces 1461 and 1462. The bending head 1410 is adjustable vertically as shown by the arrow 1440 such that a wire protruding from the wire guide 1416 through the hole 1417 will extend through either the first bending channel 1409, the second bending channel 1405, or the cutting channel 1407. Thus, by adjusting the height of the bending head 1410, a different radius may be selected for bending the wire. The bending pin 1404 extends high enough such that it can bend wires in either the first bending channel 1409 or the second bending channel 1405. In alternative examples the radius of the bending surface may vary continuously with the height of the bending dies 1463 and 1464. In that example, the height of the bending head correlates to the bending radius. As in the other embodiments, the cutting channel 1407 includes a sharp edge 1468 against which the wire may be sheared. Although the bending head 1410 is illustrated with a simple vertical surface 1483 and cutting edge 1412, a cutting insert could be used as illustrated in FIG. 13, or as would be known to a person having ordinary skill in the art.

FIGS. 6-9 depict an embodiment of the clamping mechanism in greater detail. Common elements in the drawing figures are labeled with like numbers.

Figure 6:
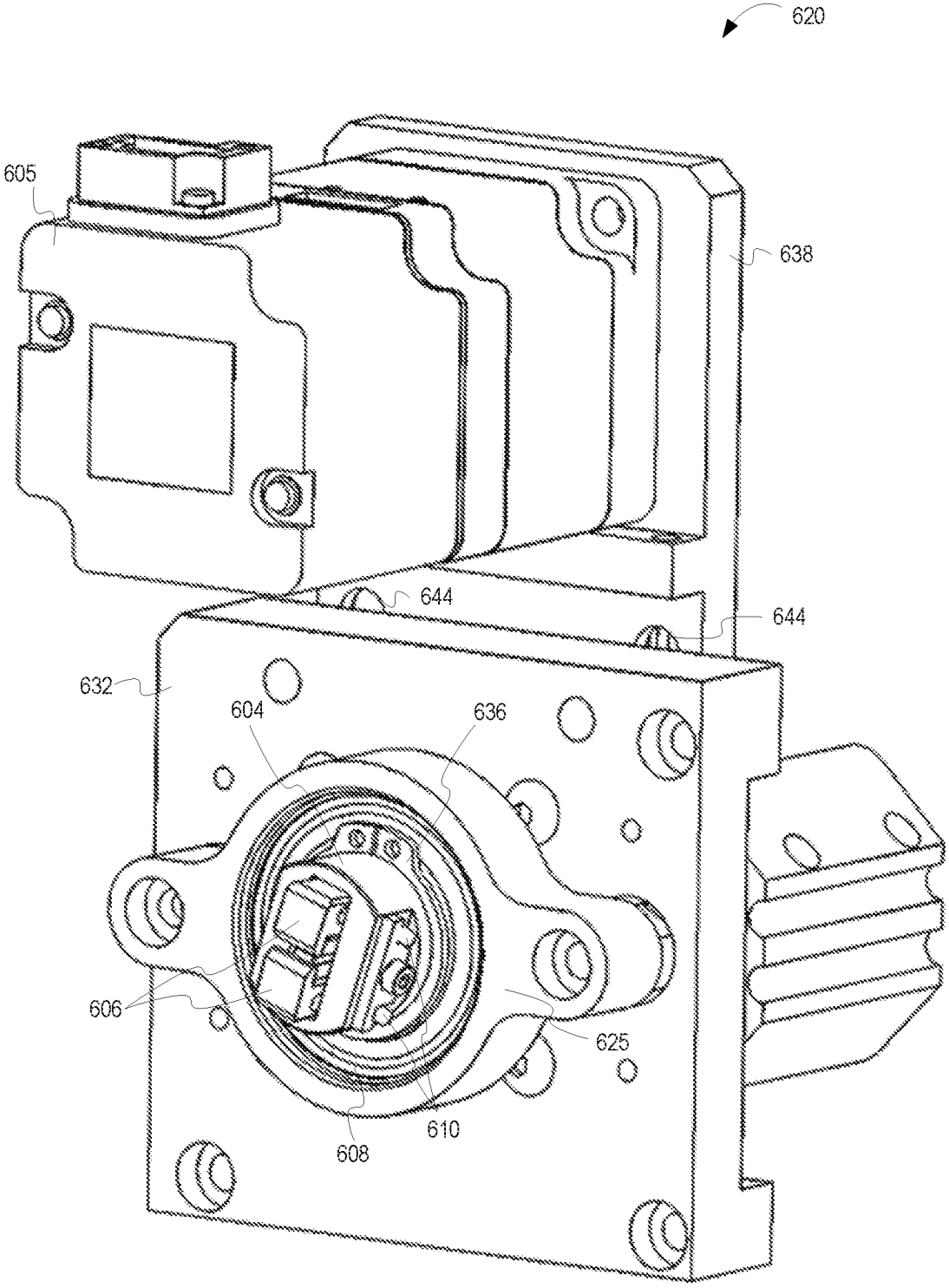
FIG. 6 is a front isometric view of a clamping mechanism of a bending machine, according to some embodiments of the inventive subject matter.
Figure 7:
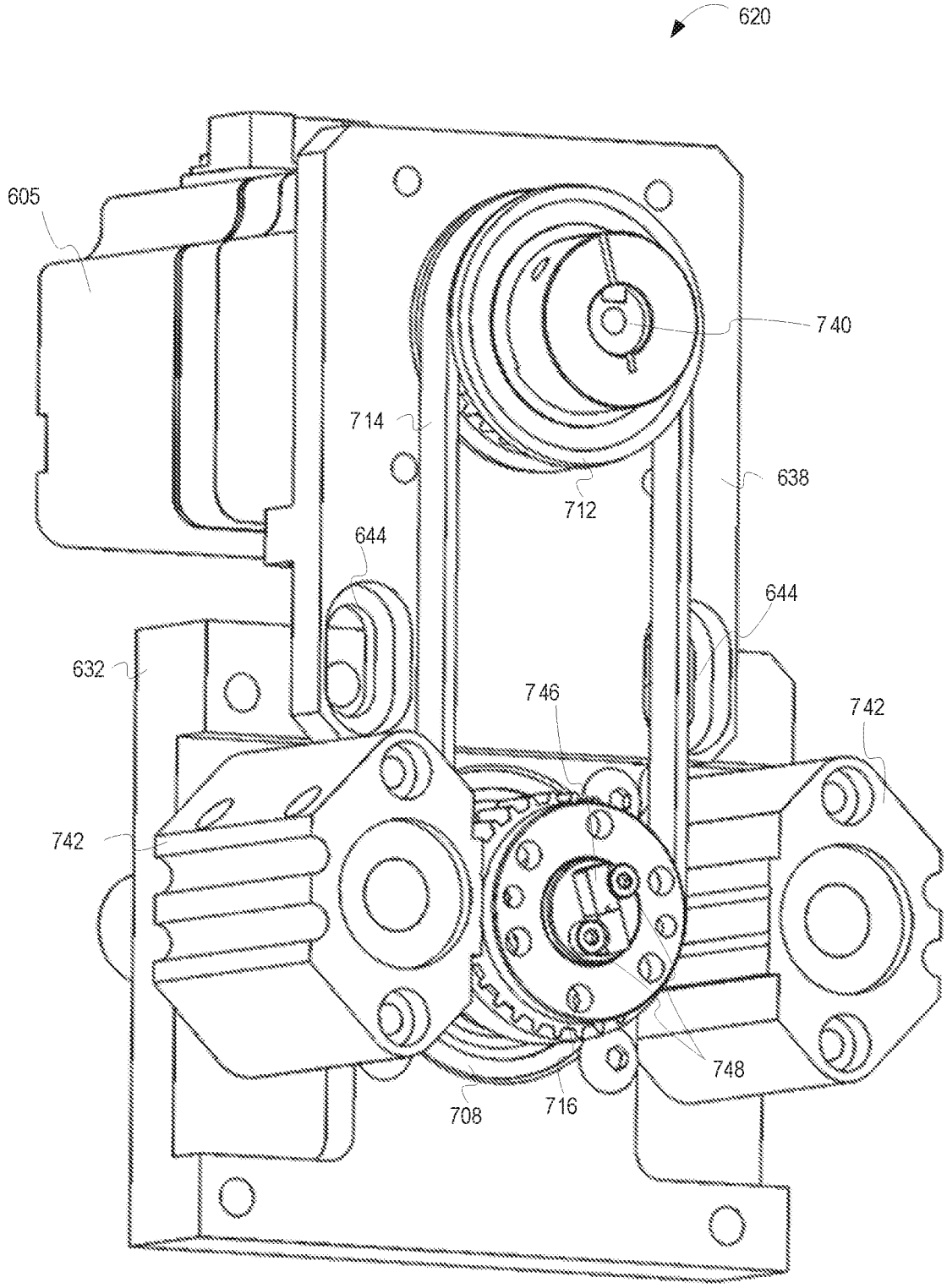
FIG. 7 is a rear isometric view of a clamping mechanism of a bending machine, according to some embodiments of the inventive subject matter.

FIG. 6 is a front isometric view of a clamping mechanism 620 of a bending machine, according to some embodiments of the inventive subject matter. The clamping mechanism includes a housing 632. The clamping mechanism secures a wire (not shown) via jaws 606. The example clamping mechanism 620 depicted in FIG. 6 includes two jaws 606. Such a design is useful when clamping wire having one or more flat sides. The clamping mechanism can also rotate the wire in between bending operations, to orient the wire in the correct plane prior to a subsequent bending operation. For example, the jaw actuation bracket 120 can include a rotary bearing 608 and the jaws 606 can be seated in a jaw holder 604 the rotary bearing 608. Such rotation allows the bending machine to bend the wire in multiple planes. The clamping mechanism includes a rotating jaw holder 604 secures the jaws 606. A jaw actuation bracket 625 supports the rotary bearing 608, as described in more detail with respect to FIGS. 8 and 9. The jaw actuation bracket 625 acts on the rotating jaw holder 604 to force the jaws 606 together to secure the wire, as described in more detail with respect to FIGS. 8 and 9. The rotating jaw holder 604 is seated in the rotary bearing 608 and thus rotates with the jaws 606. Because the rotating jaw holder 604 secures the jaws and rotates with the jaws 606, the jaws 606 can rotate without restriction through any degree of rotation. For example, the jaws 606 (and thus the wire) can rotate through a full 360° rotation (or more). This ability to rotate allows for a greater degree of flexibility when bending wire. Additionally, this ability to rotate can also decrease bending time, as bends can be made in any plane by rotating in whichever direction (i.e., clockwise or counterclockwise) orients the wire most quickly. Additionally, such limitless rotation allows for the use of drive mechanisms that only rotate in a single direction. A motor 605 rotates the clamping mechanism, as seen more clearly in FIG. 7. The motor 605 mounts to a motor mounting plate 638. The motor mounting plate 638 can included slotted holes 644 (better seen in FIG. 7) that allow adjustment of belt tension (i.e., for a belt 714, as depicted in FIG. 7). In some embodiments, the motor mounting plate 638 is an extension of the housing 632.

FIG. 7 is a rear isometric view of a clamping mechanism 620 of a bending machine, according to some embodiments of the inventive subject matter. The motor 605 includes a shaft 740 coupled to a drive pulley 712. Rotation of the drive pulley 712 causes movement of a belt 714. The belt 714 interfaces with a driven pulley 716 and thus rotates the driven pulley 716. The driven pulley 716 is connected to the rotating jaw holder 604 through a shaft that is seated in the rotary bearing 708 and thus rotates the rotating jaw holder 604 that secures the jaws 606. Consequently, when a wire is clamped in the jaws 606, the motor 605 causes rotation of the wire. Although FIG. 7 depicts a simple drive mechanism that includes only two pulleys and a belt, more complicated mechanisms can be used. For example, the drive mechanism can include a transmission, multiple belts or chains, multiple pulleys or gears, etc. Similarly, an even simpler drive mechanism can be used. For example the motor 602 may be directly coupled to the clamping mechanism (i.e., a hollow-shaft design). The clamping mechanism also includes pistons 742. The pistons 742 are mounted on the rear of the housing 632 and drive a jaw actuation bracket (depicted in FIG. 6) to clamp a wire. Wire channel blocks 746 extend through a rotary shaft (e.g., the rotary shaft 830 depicted in FIG. 8) which supports the driven pulley 716. The wire channel blocks 746 are configured to decrease the diameter of the rotary channel (i.e., create a smaller channel) so that the bending machine can accommodate wires of multiple sizes. Specifically, use of different wire channel blocks 746 allows the jaw assembly to accommodate wire of different shapes and/or sizes. The wire channel blocks 746 can be removable so that wire channel blocks 746 having different sized channels can be used. The wire channel blocks 746 can be secured by any suitable means, such as set screws 748.

Figure 8:
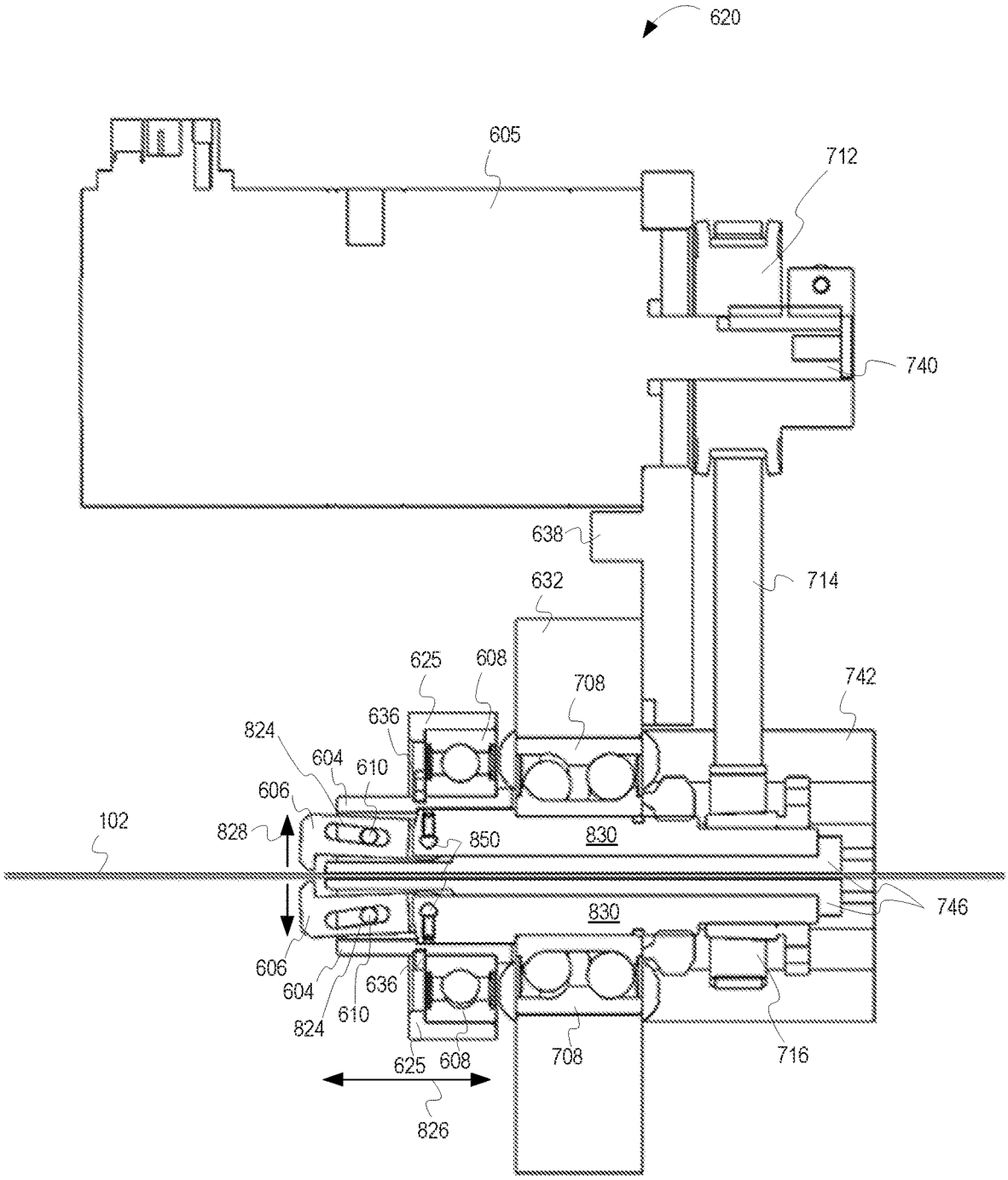
FIG. 8 is a sectional view of a clamping mechanism of a bending machine in a first position, according to some embodiments of the inventive subject matter.
Figure 9:
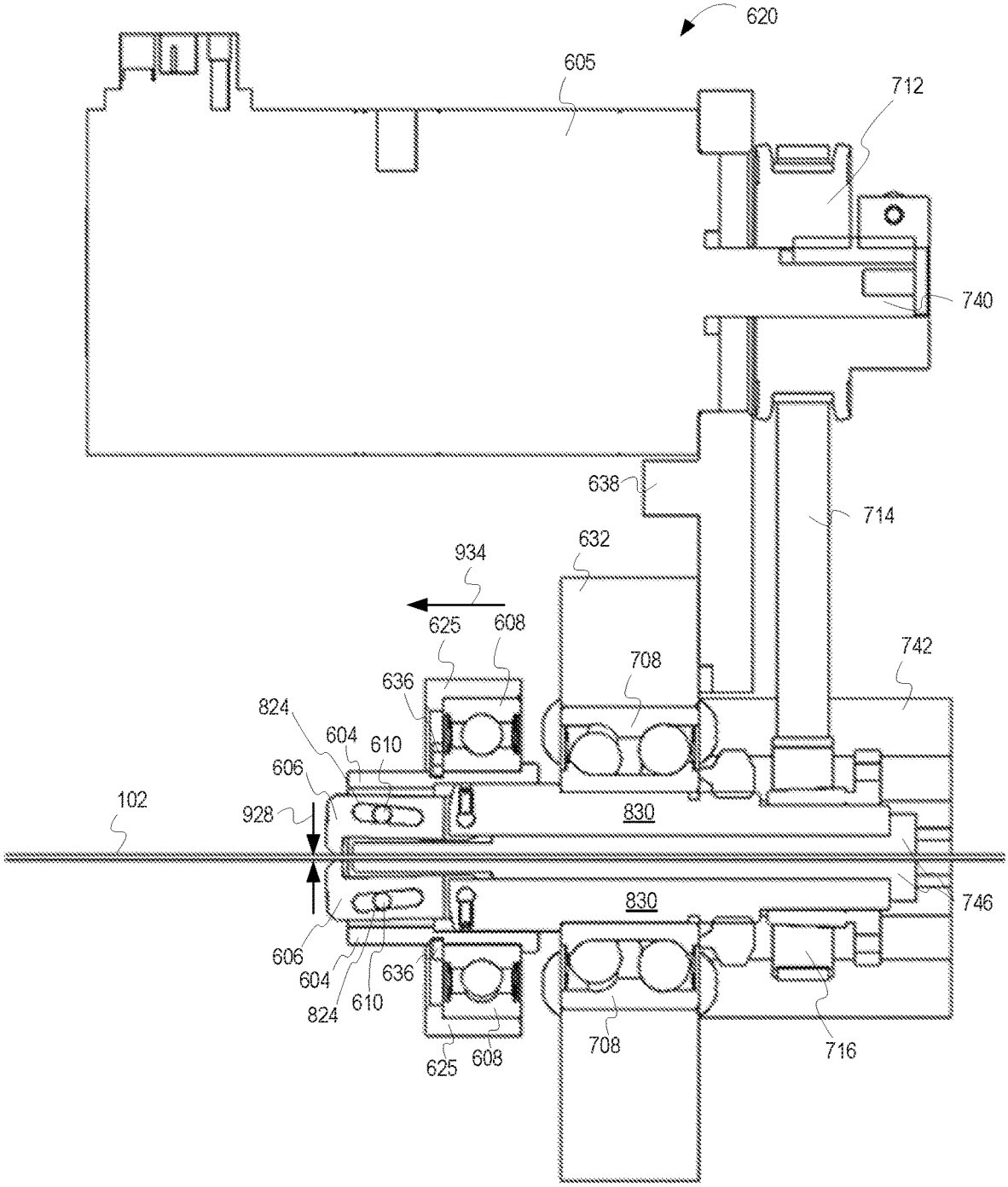
FIG. 9 is a sectional view of a clamping mechanism of a bending machine in a second position, according to some embodiments of the inventive subject matter.

While FIGS. 6 and 7 depict isometric views of the clamping mechanism, FIGS. 8 and 9 depict sectional views of the clamping mechanism.

FIG. 8 is a sectional view of a clamping mechanism (e.g., 620) of a bending machine in a first position, according to some embodiments of the inventive subject matter. In the first position, the jaws 606 are not clamped on the wire 102, as indicated by the arrow 828. Consequently, in the first position, the wire 102 is free, such that the clamping mechanism may be advanced or retracted without moving the wire. As discussed above with respect to FIG. 1A, the clamping mechanism 620 is slidably mounted to the bending machine. To advance the wire, the clamping mechanism is driven towards the bending head while the wire is clamped. At the limit of the clamping mechanism's slidable travel the clamping mechanism releases the wire and retracts away from the bending head. In one embodiment, the clamping mechanism retracts away from the bending head prior to loading a new wire to increase the amount of wire it can feed before arriving at the limit of the clamping mechanism's slidable travel.

A rotary shaft 830 runs through the housing 832 and is supported by the rotary bearing(s) 708. The rotary shaft 830 includes a channel through which the wire 102 is fed. The channel is formed by wire channel blocks 746 that are removable from the rotary shaft 830. Because the wire channel blocks 746 are removable, they can be sized to fit a variety of wire shapes or sizes. For example, wire channel blocks 746 with a channel having a diameter smaller than that of the rotary shaft 830 allow the wire bending machine to accommodate smaller wire. The jaws 606 are coupled to the rotary shaft 830 via jaw pivot pin 850. The jaws 606 are free to open and clamp shut by rotating on the jaw pivot pin 850. The rotary shaft 830 is also coupled via the rotating jaw holder 604 to the jaws 606. Axial movement (illustrated by the arrow 826) of the jaw actuation bracket 625 can force the jaws 606 together using any suitable means. For example, the jaws 806 can be shaped such that they protrude further from the wire at one end, such that the rotating jaw holder 804 forces the jaws 806 together when the jaw actuation bracket 625 is extended over the jaws 606. An alternative embodiment is depicted in FIGS. 8 and 9. As illustrated in FIGS. 8 and 9, the rotating jaw holder 604 includes jaw actuation pins 610 that engage jaw actuation pin slots 824 in the jaws 606. The jaw actuation pin slots 824 are angled in such a manner such that the jaw actuation pins 610 force the jaws together when the jaw actuation bracket 625 is extended over the jaws 606.

As described above, the rotary shaft 830 is coupled via the rotating jaw holder 604 to the jaws 606 on a front end and the driven pulley 816 on the back end. Consequently, the jaws 606 rotate with the rotary shaft 830 as the motor 802 rotates. A jaw actuation bracket 625 is coupled via the pistons 742 to the housing 832. The jaw actuation bracket 625 encircles the rotating jaw holder 604. The rotating jaw holder 604 is supported by the thrust bearing 608 and can therefore spin freely within the jaw actuation bracket 625. The jaw actuation bracket 625 is secured via the thrust bearing 608 to the jaw actuation bracket 608 by a rotating jaw holder retainer 636. The jaw actuation bracket 625 is movable, as indicated by the arrow 826. When the clamping mechanism is in the first position, the jaw actuation bracket 625 and the rotating jaw holder 604 is advance towards the jaws 606.

When in the second position (depicted in FIG. 9), the jaw actuation bracket 625 is retracted towards the housing and forces the jaws 606 closed via the rotating jaw holder 604.

FIG. 9 is a sectional view of a clamping mechanism of a bending machine in the second position, according to some embodiments of the inventive subject matter. In the second position, the jaw actuation bracket 625 is retracted towards the housing 632, as indicated by the arrow 934. The jaw actuation bracket 625 moves the rotating jaw holder 604 which causes the jaw actuation pins 610 to move forward in the jaw activation pin slots 624. Via this movement, the jaw actuation pins 610 exert a camming force on the jaws 606 that forces the jaws 606 together, as indicated by the arrows 928. When the jaws 606 are forced together, they clamp the wire 102. Because the rotating jaw holder 604 is rotatable with respect to the housing and the jaw actuation bracket 920, the rotating jaw holder 604 can exert the forces on the jaws 606 while the jaws 606 (and rotating jaw holder 604) rotate. Such an arrangement allows the clamping mechanism to clamp the wire 922 and rotate the wire through a 360° (or greater) rotation.

Figure 10:
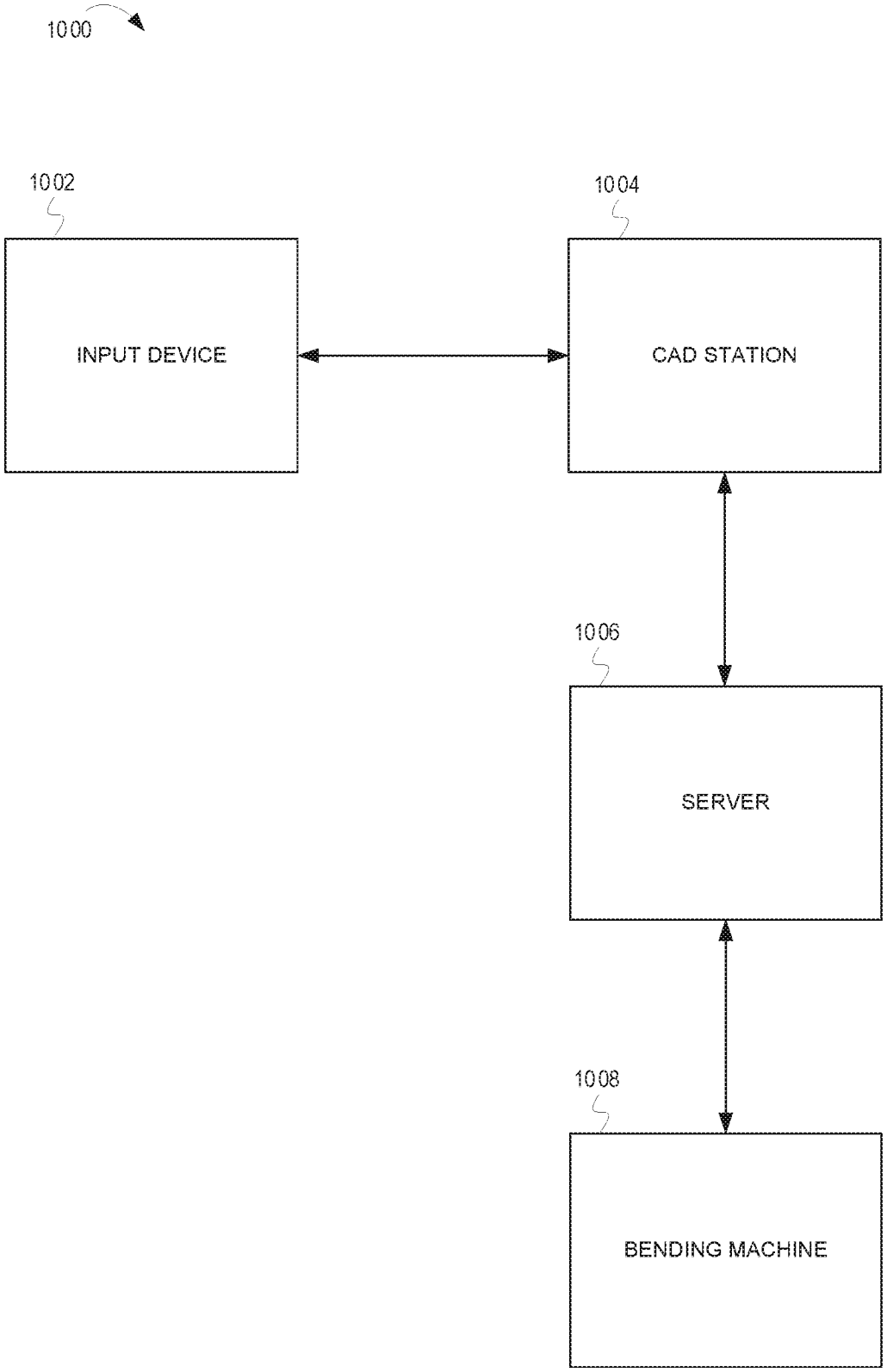
FIG. 10 is a block diagram of a system 1000 for automatically manufacturing orthodontic wire, according to some embodiments of the inventive subject matter.
Figure 11:
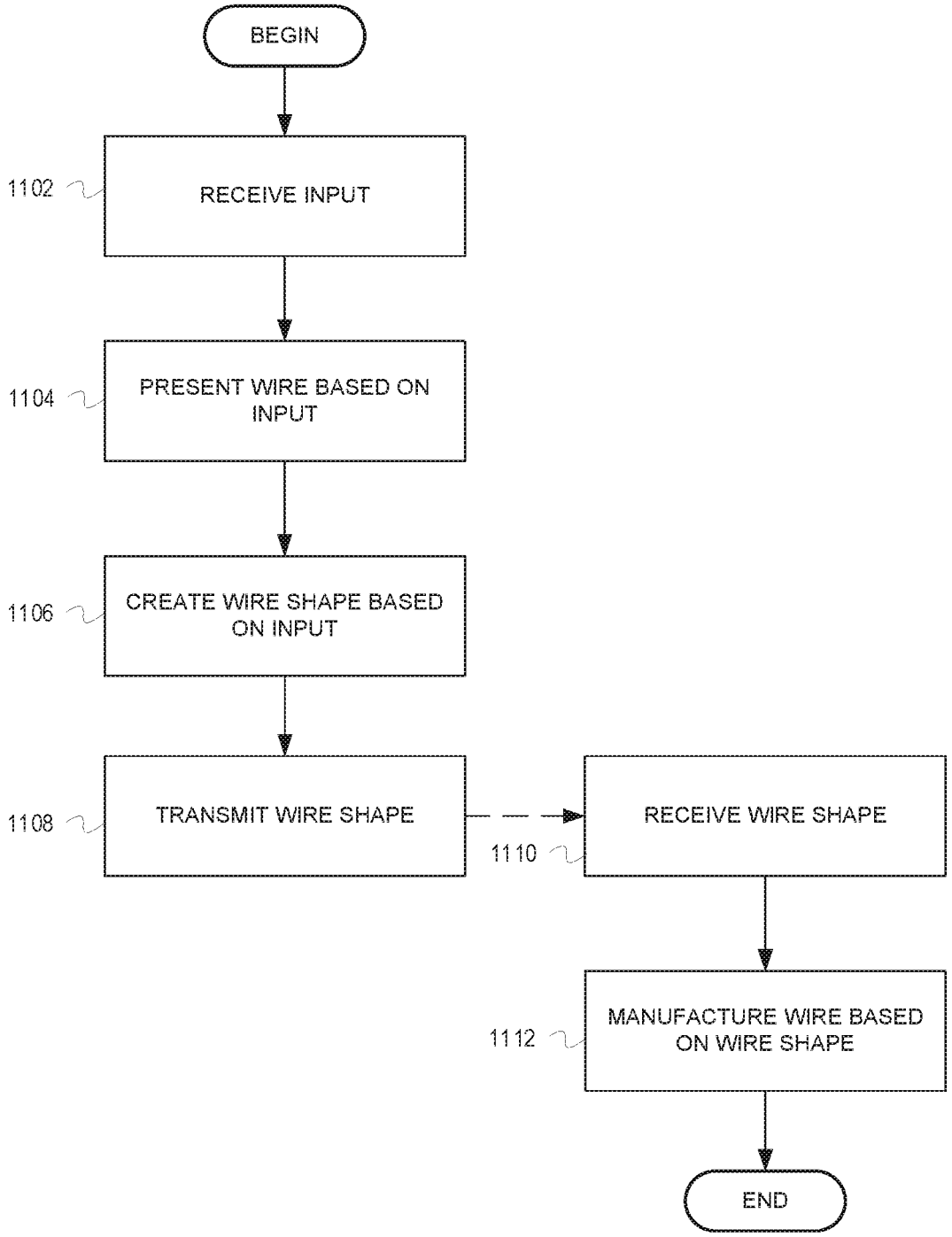
FIG. 11 is a flow chart depicting example operations for automatically manufacturing orthodontic wire, according to some embodiments of the inventive subject matter.

While FIGS. 1-9 and 12-14 and the related text describe some features of the wire bending machine, FIGS. 10-11 and the related text describe using the wire bending machine, according to some embodiments of the inventive subject matter.

FIG. 10 is a block diagram of a system 1000 for automatically manufacturing orthodontic wire, according to some embodiments of the inventive subject matter. The system 1000 includes an input device 1002, a computer-aided design ("CAD") station 1004, a server 1006, and a bending machine 1008. In some embodiments, the input device 1002, CAD station 1004, server 1006, and bending machine 1008 are local to one another. In such embodiments, the bending machine 1008 can be small enough such that the system 1000 can be located within an orthodontic practitioner's office. In other embodiments, one or more components of the system 1002 may be remote from others of the components. For example, the input device 1002 and the CAD station 1004 can be located at a practitioner's office and the bending machine 1008 can be located at a remote facility. In either the embodiment, the system 1000 can be used to produce an orthodontic wire.

The input device 1002 receives and/or generates data associated with a patient's mouth. For example, the input device 1002 can determine locations of the patient's teeth and/or desired locations for orthodontic appliances (e.g., brackets). Accordingly, the input device 1002 can take any suitable form. In one embodiment, the input device 1002 is a computer including a pointing device, such as a mouse, and any other devices required to capture an image of a patient's mouth, such as an oral imaging device. The computer presents an image of the patient's mouth (two or three dimensional) and a user can use the pointing device to select positions on the image on which to place orthodontic appliances. The image of the patient's mouth may be captured directly by scanning the patient's mouth with an oral imaging device, or indirectly, by scanning a model or casting of the patient's mouth. In an alternative embodiment, the input device 1002 can be a haptic device with which the user can select positions on a model of the patient's mouth on which to place orthodontic appliances. The haptic device can be a handheld device (e.g., a wand) or a computer controlled device (e.g., an articulating arm including a haptic sensor). The user can either select points at which he/she wishes the orthodontic appliance to be placed, or trace a path along which he/she wishes the wire to traverse.

The CAD station 1004 receives the data from the input device and determines a wire shape based on the data. In embodiments in which the user selects the locations at which he/she wishes to place the orthodontic appliances, the CAD system 1004 presents the wire along a path consistent with the selected locations. In some embodiments, the CAD system 1004 presents the wire in real time as the user selects the locations (i.e., the CAD systems presents the wire as the input is received). In some embodiments, the CAD system 1004 can determine locations at which the orthodontic appliances should be placed based on one or more locations selected by the user or predefined templates. After the CAD system 1004 determines the locations at which the orthodontic appliances should be placed, the CAD system 1004 presents a representation of the wire. In some embodiments, the user can manipulate the representation of the wire. For example, the user can manipulate the representation of the wire by scaling, translating, rotating, lengthening, shortening, smoothing, fitting, etc. the representation of the wire. The CAD system 1004 generates a wire shape part program file that the bending machine 1008 can use to manufacture the wire.

The server 1006 receives the wire shape part program file. In local embodiments, the server 1006 can be an interface or bus between the CAD system 1004 and the bending machine 1008. In remote embodiments, the server 1006 can be an intermediary node within a communications network.

The bending machine 1008 receives the wire shape part program file and manufactures the wire based on the wire shape file. The bending machine 1008 can take the form of the wire bending machine described herein or any other suitable wire bending machine. As previously discussed, in embodiments in which all components of the system 1000 are local, the system 1000 can be located in a practitioner's office. Such a configuration may decrease both the time and the cost of manufacturing wires.

In addition to being used to manufacture wires for orthodontia, systems similar to those depicted in FIG. 10 can be used to manufacture any type, size, or shape of wire.

While FIG. 10 depicts a system for manufacturing wire, FIG. 11 is a flow chart depicting example operations for using such a system.

FIG. 11 is a flow chart depicting example operations for automatically manufacturing orthodontic wire, according to some embodiments of the inventive subject matter. In some embodiments, the operations of blocks 1102-1108 are performed by a first device, such as a CAD system and the operations of blocks 1110-1112 are performed by a second device, such as a bending machine and its associated controller. The flow begins at block 1102.

At block 1102, input is received. For example, a CAD system can receive input from an input device. The input can take any suitable form (e.g., any suitable data format or data type). In some embodiments, the input is a scan or other representation of a patient's mouth. For example, oral imaging devices are known, which provide data that describes the shape of a patient's mouth. In another example, a scanning device may be used to capture scan data from a casting or model of the patient's mouth. After receiving the scan data, the CAD system displays an image of the patient's mouth and enables a user to select locations at which an orthodontic wire will contact the patient's teeth. In addition to, or in lieu of, a representation of a patient's mouth, the input can include locations at which orthodontic appliances should be installed. For example, a casting of a patient's mouth might be created. Using a haptic input device such as a contact probe or a coordinate measuring machine (CMM), a user selects locations at which an orthodontic wire will contact the patient's teeth by capturing points on the casting. The flow continues at block 1104.

At block 1104, a representation of the wire is presented. For example, the CAD system can present a representation of the wire via a display device. In some embodiments, the CAD system presents the representation of the wire in real time as a user selects locations at which orthodontic appliances should be placed. The flow continues at block 1106, At block 1106, a wire shape based on the input is created. For example, the CAD system can create the wire shape based on the input. In some embodiments, the CAD system creates the wire shape based on predefined templates in addition to the input. In such embodiments, the user may be able to manipulate the wire shape. The CAD system can generate the wire shape automatically based on locations of the patient's teeth and desired final positions of the patient's teeth. For example, the CAD system can calculate a wire shape that will achieve the desired movement. The CAD system can also generate a wire shape file based on the wire shape. The wire shape file can take any suitable form. The flow continues at block 1108.

At block 1108, the wire shape is transmitted. For example, the CAD system can transmit the wire shape. The CAD system can transmit the wire shape via the wire shape file. The CAD system can transmit the wire shape via any suitable communications network. The flow continues at block 1110.

At block 1110, the wire shape is received. For example, a bending machine can receive the wire shape. The flow continues at block 1112.

At block 1112, a wire based on the wire shape is manufactured. For example, the bending machine can manufacture the wire based on the wire shape. The bending machine can manufacture the wire by bending and/or cutting the wire based on the wire shape file.

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims. Each of the embodiments described herein are contemplated as falling within the inventive subject matter, which is set forth in one or more of the following claims.

What is claimed is:

1. A wire bending machine comprising:

a bending head disposed on the bending machine; and a clamping mechanism disposed adjacent to the bending head, the clamping mechanism further comprising:

a housing;

a rotary shaft extending through the housing, wherein the rotary shaft includes a wire channel and is rotatable within the housing;

two or more jaws, wherein the two or more jaws are coupled to the rotary shaft;

a rotating jaw holder, wherein the rotating jaw holder encircles the two or more jaws and is supported by a bearing within a jaw actuation bracket;

the jaw actuation bracket, wherein the jaw actuation bracket encircles the rotating jaw holder, and wherein the jaw actuation bracket is movably coupled to the housing;

wherein the rotating jaw holder is rotatable within the jaw actuation bracket; and wherein the jaw actuation bracket is movable from a first position to a second position, wherein when the jaw actuation bracket is in the second position it urges the two or more jaws together.

2. The wire bending machine of claim 1, further comprising:

a wire guide disposed between the bending head and the clamping mechanism, the wire guide comprising an enclosed wire channel and a holding pin;

an actuator coupled to the holding pin and configured to selectively drive the holding pin into the enclosed wire channel such that a wire in the enclosed wire channel is fixed relative to the enclosed wire channel.

3. The wire bending machine of claim 1, wherein a wire guide is disposed between the bending head and the clamping mechanism and the wire guide is slidable relative to the bending head.

4. The wire bending machine of claim 3, wherein the clamping mechanism further comprises:

a motor, wherein the motor is mechanically coupled to the rotary shaft so as to rotate the rotary shaft and the rotating jaw holder.

5. The wire bending machine of claim 1, wherein the clamping mechanism further comprises:

one or more jaw actuation pins disposed on the rotating jaw holder; and a jaw actuation pin slot formed within the two or more jaws;

wherein the one or more jaw actuation pins engage the jaw actuation pin slot such that when the jaw actuation bracket is in the second position the jaw actuation pin slot urges the jaws together.

6. The wire bending machine of claim 1, wherein the clamping mechanism further comprises:

a removable wire channel block, wherein the removable wire channel block is seated within the wire channel to form an orifice designed to receive a wire having a specific size.

7. The wire bending machine of claim 1, wherein the bending head further comprises:

an inner portion comprising a bending head channel aligned with the wire channel, and an outer portion rotatable about the inner portion on an axis of rotation substantially perpendicular to the bending head channel, wherein the outer portion comprises at least one bending pin disposed on a surface perpendicular to the axis of rotation and a cutting edge, and wherein the outer portion is movable from a first outer portion position in which the at least one bending pin is configured to engage a wire, to a second outer portion position in which the cutting edge is configured to shear the wire.

8. The wire bending machine of claim 7, further comprising a drive mechanism coupled to the bending head, wherein the drive mechanism is configured to adjust a vertical position of the bending head.

9. The wire bending machine of claim 8, wherein the cutting edge of the outer portion is directly adjacent to a wire guide such that the cutting edge is configured to shear the wire against the wire guide.

10. The wire bending machine of claim 7, further comprising:

a drive mechanism coupled to the bending head, the drive mechanism being configured to adjust a position of the cutting edge relative to the wire; and a control circuit, wherein the control circuit is configured to store a history of at least one prior usage of the cutting edge in a memory accessible by the control circuit.

11. The wire bending machine of claim 10, wherein the control circuit is further configured to:

determine a first cutting edge position of the cutting edge relative to the wire;

select a second cutting edge position different than the first cutting edge position of the cutting edge based at least in part on the history of the at least one prior usage of the cutting edge;

command the drive mechanism to move the cutting edge to the second cutting edge position.

12. The wire bending machine of claim 11, wherein the control circuit is further configured to:

determine that the first cutting edge position of the cutting edge is dull based at least in part on the history of the at least one prior usage of the cutting edge.

13. The wire bending machine of claim 1, wherein the clamping mechanism is slidable relative to the bending head.

14. The wire bending machine of claim 1, wherein the bending head further comprises:

an inner portion comprising a bending head channel aligned with the wire channel;

a cutting channel disposed within the inner portion of the bending head, the cutting channel substantially aligned with and vertically adjacent to the bending head channel;

an outer portion rotatable about the inner portion on an axis of rotation substantially perpendicular to the bending head channel, the outer portion comprising at least one bending pin disposed on a surface perpendicular to the axis of rotation and a cutting edge;

a cutting surface disposed on the outer portion of the bending head, wherein the cutting surface is substantially parallel to the axis of rotation, wherein the cutting edge is disposed on the cutting surface such that in a first rotational position of the outer portion the cutting edge is configured to shear a wire against the cutting channel and in a second rotational position of the outer portion, the outer portion does not obstruct passage of the wire through the bending head channel of the bending head.

15. The wire bending machine of claim 14, further comprising a removable cutting insert wherein the cutting edge is disposed on the cutting insert.

* * * * *